United States Patent [19]

Yoshida et al.

[11] 4,020,627

[45] May 3, 1977

[54] LIQUID CRYSTAL DISPLAY ELECTRONIC WATCH

[75] Inventors: Masateru Yoshida, Tanashi; Yoshio Iinuma, Higashimurayama; Tetuya Yasuda, Tokyo; Satoshi Kimura, Tokorozawa, all of Japan

[73] Assignee: Citizen Watch Co., Ltd., Tokyo, Japan

[22] Filed: Oct. 1, 1974

[21] Appl. No.: 510,918

[30] Foreign Application Priority Data

Oct. 6, 1973 Japan ..... 48-116100

[52] U.S. Cl. ..... 58/50 R; 58/4 A; 58/23 A; 58/55; 58/85.5; 361/400; 340/324 M

[51] Int. Cl.[2] ..... G04B 19/30; G04B 19/24; G04B 27/00; G08B 23/00

[58] Field of Search ..... 58/4 A, 23 A, 50 R, 58/55, 85.5; 340/324 M; 317/101 CC

[56] References Cited

UNITED STATES PATENTS

| | | | |
|---|---|---|---|
| 3,689,131 | 9/1972 | Klein | 340/324 R X |
| 3,718,842 | 2/1973 | Abbott et al. | 317/101 CC |
| 3,757,510 | 9/1973 | Dill | 58/23 R |
| 3,778,999 | 12/1973 | Vuffray | 58/23 R |
| 3,838,568 | 10/1974 | Zupcher | 58/88 C |
| 3,861,135 | 1/1975 | Seeger, Jr. et al. | 58/50 R |
| 3,863,436 | 2/1975 | Schwarzschild | 58/53 |
| 3,866,406 | 2/1975 | Roberts | 58/4 A |

*Primary Examiner*—E. S. Jackmon
*Attorney, Agent, or Firm*—Sherman & Shalloway

[57] ABSTRACT

A liquid crystal display electronic watch comprises a metal substrate, whose upside and downside surfaces are insulated by a flexible print sheet. A liquid crystal cell and a time keeping decoder drive circuit are arranged on the upside of the substrate and other circuit elements are arranged beneath the downside thereof. The exteriorly operating parts are arranged around the periphery of the substrate. All of the electrical and mechanical operating members are arranged in a plane with respect to the substrate and so electrically connected and mechanically interlocked that date and/or week day are displayed with the least possible members. The watch is thin, small, simple in construction and reliable in operation.

11 Claims, 31 Drawing Figures

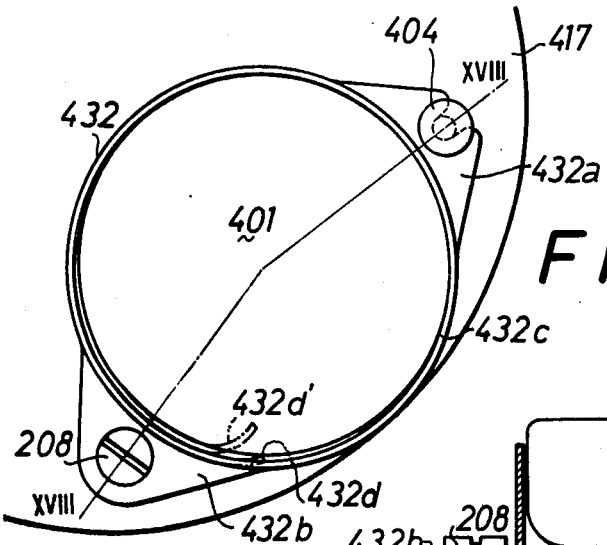
FIG. 17
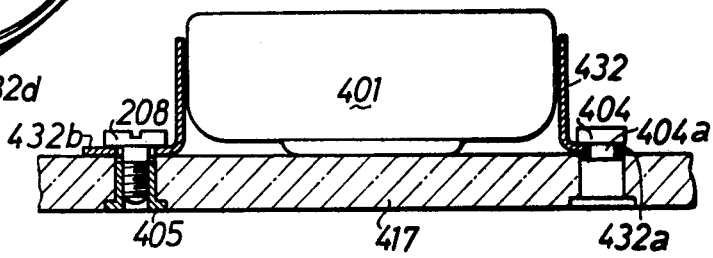
FIG. 18
FIG. 19
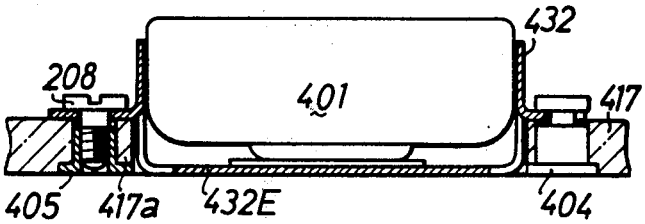
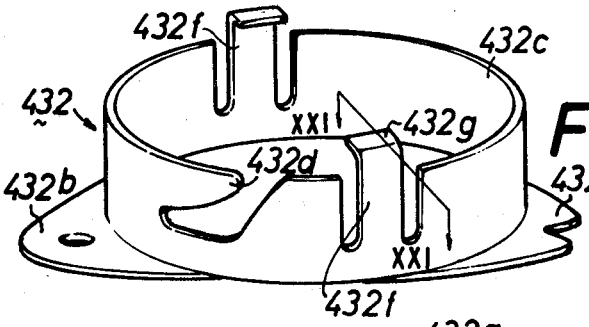
FIG. 20
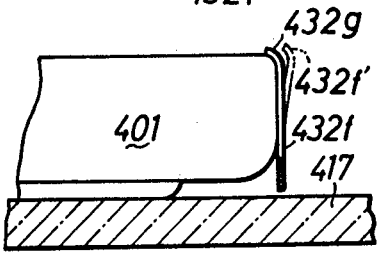
FIG. 21

LIQUID CRYSTAL DISPLAY ELECTRONIC WATCH

BACKGROUND OF THE INVENTION

1. Field of the Invention

The present invention relates to a liquid crystal display electronic watch and more particularly to a mechanical construction thereof.

2. Description of the Prior Art

Recent rapid development of electronic technique and the like has resulted in real problem in constructing liquid crystal display electronic watches. The liquid crystal display electronic watch is of up-to-date design, but encumbered with a number of difficult problems which impede its practical use as proven by those already proposed and sold in the market, place contrary to the mechanical watch which has a history of several hundred years and subsequently developed hand type electronic watch. The pressing need at present is to provide a liquid crystal display electronic watch which provides a material decrease in electric wirings; takes up less dead space owing to effective arrangement of constitutional elements; provides the least possible members for displaying date and/or week day; and of which the constitutional elements are similar in construction with each other and simple in operation.

The conventional liquid crystal display electronic watch has a number of disadvantages.

As shown in FIG. 25, a circuit construction of the conventional liquid crystal display electronic watch comprises: a crystal oscillator circuit 2; an oscillation frequency divider circuit 6; a time keeping decoder drive circuit 9 composed of a correction circuit, a time keep circuit and decode circuit; and a display circuit 10 receiving signals from the decode circuit and for displaying week day, date, hour, minute, second and the like. The time keeping circuit receives an output signal from the oscillation frequency divider circuit 6 and counts time to deliver an output to the decode circuit. The correction circuit receives an output signal from the oscillation frequency divider circuit 6 and also receives a signal produced when an exteriorly operating member is operated to make a switch member ON or OFF, thereby delivering an output signal to the time keeping circuit and hence operating the decode circuit and the display circuit 10 to correct the display effected by the display circuit.

The correction circuit becomes unstable when the switch member is OFF so that there is a risk of the correction circuit being erroneously operated when the switch member is ON. Thus, the correction circuit must be held in its stable state, during the time when the switch member is OFF state. For this purpose, it has been the common practice to use a system such as that shown in FIG. 7. In the system shown in FIG. 7, those circuit portions of a correction circuit 109 which correspond to the above mentioned switch members are connected through level shifting resistors $R_1$ to $R_5$ to a (−) terminal which is grounded. This system, however, has the disadvantage that it takes up much space, is liable to limit the arrangement of the other watch members or electron circuits, and is liable to make the watch thick and large.

There are two kinds of cases, one of which can remove a movement from a back cover side, and the other of which can remove the movement from a dial side. Heretofore, it has been the common practice to use a setting lever to detachably mount a winding stem on the watch in the case of applying one kind of movement to the above mentioned two kinds of cases. But, the use of such setting lever is limited to one of the two kinds of cases only, and as a result, when it is desired to detachably mount the winding stem on the other kind of case, provision must be made of means other than the setting lever.

In an electronic watch or recent liquid crystal display watch which makes use of a battery as its power source, it has been the common practice to deform a part of a train-wheel bridge or of a circuit substrate into a depressed portion with surrounds the outer periphery of the battery and into which the depressed portion encloses the battery, so as to determine the position of the battery in its flat surface direction, and to support the battery. A battery supporting member is channel-shape in section.

Such means of supporting the battery by a single substrate of the liquid crystal display electronic watch could not rigidly support the battery in its plane direction, regardless irrespective of shocks subjected to the watch.

In the liquid crystal display electronic watch, a crystal oscillator unit is enclosed in the case with two terminals exteriorly exposed and supported at a given position on a print sheet or watch substrate. Heretofore, it has been the common practice to mechanically support the oscillator unit by the watch substrate and the like by means of a plate-shaped member for pushing the oscillator unit into a socket or by means of solder which is used to directly bond the exterior connection terminals with the print sheet. Electrical connection between the exterior connection terminals and exterior circuits is effected through a socket secured to the watch substrate and the like or is effected by soldering the exterior connection terminals with lead wires. Such conventional crystal oscillator unit, supporting construction, is troublesome and consume a lot of time to secure the oscillator unit to the plate-shaped member and makes the watch substrate and the like complex in construction.

In the case of a crystal watch and the like which requires a particularly supper miniature crystal oscillator, it is impossible to provide a space in which the socket is located. In addition, there is a risk of the crystal oscillator being broken by being subjected to shocks, and, as a result, the crystal oscillator must easily be replaced by a new one.

Heretofore, it has been the common practice to use a transistor and an inductance coil for the purpose of obtaining a booster source. As a result, it is impossible to provide an integrated circuit which corresponds to the above mentioned complementary type MOS integrated circuit. In addition, it is required to use the inductance coil in the form of a coil wound around an iron core. Moreover, the inductance coil can not be made smaller than a given required size in view of its efficiency and requires complex manufacturing steps which causes a hindrance in constructing the watch. In addition, the use of the inductance coil requires a direct current source having an undisuable load changing rate, thereby requiring a circuit for stabilizing the direct current source and hence a number of electron elements. This provides a material increase in volume occupied by the electron elements, which is a vital disadvantage in the case of constructing the watch.

In addition, the liquid crystal display electronic watch, that is, a digital type electronic watch is composed of a LSI such as a C-MOS, or the like, which is complex in circuit construction and has a number of connection points which are required to turn a display member on and off. Particularly, if a liquid crystal cell is used as the display member, it is necessary to replace the liquid crystal cell by a new one since liquid crystal substance has a comparatively short life span. In this case, electrical and mechanical connections are effected with the aid of spring contacts and, as a result, it is difficult to ascertain whether or not the electrical and mechanical connections are reliably completed.

In the digital electronic watch which can effect its display with the aid of a liquid crystal or photodiode, the display is corrected by means of a plurality of push buttons or a crown as in the case of the mechanical watch. In the case of correcting the display by means of a plurality of push buttons, the push buttons are arranged at those positions on the case at which the display is to be corrected, or the positions at which the display is to be corrected are marked on the case for the purpose of preventing erroneous correcting operations, thereby simplifying the operations. But, if the display must be effected with respect, not only to hour and minute but also, to date and week day, it is difficult to provide push buttons for all of the correcting elements of the watch which has limited space. Consequently large numbers of the push buttons makes the design of the watch difficult.

A device for correcting the display by a combination of push buttons as that the number of push buttons can be reduced has also been proposed. Such a device, however, is complex in operation and liable to result erroneous operation.

In the case of correcting the display by means of the winding crown, all of the correcting functions are concentrated at one point and, as a result, such a correcting device is complex in mechanism. Since most of the digital electronic watches make use of a crystal as its standard signal source, these watches have an accuracy with several seconds per month during more than a pairs operation. As a result, after these watches have been set, the correction of seconds only is required. Thus, the same operating member, i.e. the crown must be used for the purpose of correcting not only the displays which frequently occur, but also the displays which seldom occur. Such device is also complex in operation and liable to result in erroneous operation.

In chronographs or calendar timepieces, it has heretofore been the common practice to use a correcting push button. In this case, the push button is arranged near the crown, that is, arranged at that portion of the dial which is near two or four o'clock location.

As described above, if the push button is arranged near the winding crown, a setting lever, a clutch lever, gear wheels and the like operated by the winding crown as well as levers operated by the push button are concentrically arranged. Such arrangement makes the mechanism complex in design and manufacture and makes the watch relatively thick. In addition, the watch case is difficult to design.

Thus, it is necessary to separate the push button from the winding crown, and to take into consideration ease of handling and pleasing appearance of the watch.

In the conventional watch, the push button is arranged near the winding crown. The push button arranged near the two o'clock position results in easy handling, but the push button arranged near four o'clock is difficult in handling because, when the watch is put on a user's left wrist, the user must turn his right hand thumb around the winding crown.

SUMMARY OF THE INVENTION

An object of the invention is to provide a liquid crystal display electronic watch, that is, a digital all electronic watch which can obviate all of the disadvantages which have been encountered with the prior art techniques and which is comparable with the conventional hand type watch which displays week day and date.

A feature of the invention is the provision of a liquid crystal display electronic watch which comprises a metal substrate provided at its upside and downside with a flexible print sheet for wirings; a liquid crystal cell and time keeping decoder drive circuit both arranged on the upside of said metal substrate; a crystal oscillator, oscillation frequency divider circuit, trimmer condenser, fixed condenser, booster circuit, an battery all arranged beneath the downside of the metal substrate; and operating parts adapted to be exteriorly operated and arranged at the periphery of the metal substrate.

The invention allows using only two upside and downside flexible print sheets for performing overall wirings, and reducing the number of electrical connection points to the least possible number.

A combination of the metal substrate which can precisely be worked so as to form a small hole therein, tapped hole, a pin, a depressed portion and the like all adapted for use to determine positions of fixing and enclosing various constitutional elements and a flexible print sheet which, when subjected to bend shaping can perform three dimensional wirings, renders it possible to effectively arrange the various constitutional elements.

In addition, the invention is capable of providing a complex exterior operating mechanism for displaying the week, day, date and the like by pushing, pulling and rotating the winding crown representing the winding stem, setting lever spring, and clutch lever in a manner similar to the method of operating the conventional watch by means of the mechanism similar to that used in the conventional watch.

Moreover, the use of the measures described in arranging the time keeping decoder drive circuit at that side of the upside of the watch substrate, which is opposed to the liquid crystal cell, of the circuit requiring a number of wirings to be connected to the exterior lead wires of the liquid crystal cell, of concentrating the electrical connections to the center part of the watch substrate so as to simplify the wirings, and of arranging the exteriorly operating mechanism around the periphery of the watch substrate, ensures a material increase in density of assembled constitutional elements. Furthermore, it provides a liquid crystal display electronic watch which is reliable in operation, thin, small, which can perform a week day and date display function, as well as exterior operations in substantially the same manner, as the prior art watch, which can significantly increase yield with the aid of a combination of the precise working technique and the electronic technique, and which is easy in after service.

Another object of the invention is to provide a liquid crystal display watch including a level shifting resistor required for a plurality of switching members and arranged adjacent to the switching members on the same substrate.

A third object of the invention is to provide a liquid crystal display electronic watch including one setting lever capable of detachably mounting a winding stem on the watch for two kinds of cases in which the movement is removed through the downside cover and through the upside dial, respectively.

A fourth object of the invention is to provide a liquid crystal display electronic watch including a battery supporting member which can rigidly support the battery by a comparatively thin single watch substrate irrespective of shocks subjected to the watch in its planar direction, which is provided at its one part with a resilient portion capable of performing an electrical connection with a terminal of the battery, and which can detachably mount the battery thereon in an easy manner.

A fifth object of the invention is to provide a liquid crystal display electronic watch including an oscillator unit supporting device which can mechanically support the oscillator unit and can electrically connect it to exterior wirings in an easy manner and which is simple and compact in construction.

A sixth object of the invention is to provide a liquid crystal display electronic watch including an electronic booster circuit constructed by an integrated circuit technique.

A seventh object of the invention is to provide a liquid crystal display electronic watch including checking terminals whose position can easily be checked after completion of the movement of the watch with or without fixing the case thereto.

An eighth object of the invention is to provide a liquid crystal display electronic watch, that is, a digital electronic watch including a push button capable of performing correcting operations frequently required, the other correcting operations seldom required being performed by the adjusting crown, winding crown per se, which is similar to the of a spring switch and which has a good appearance in balance, that is, including a push button arranged near eight o'clock on the dial of the conventional hand type watch, the adjusting crown being arranged near three o'clock on the same dial and spaced apart from the push button, and capable of being easily operated by user and having a good balanced appearance.

BRIEF DESCRIPTION OF THE DRAWINGS

FIG. 17 is a plan view of a second embodiment of the battery supporting means of the liquid crystal display electronic watch according to the invention;

FIG. 18 is a section on line XVIII—XVIII of FIG. 17;

FIG. 19 is the same section as FIG. 18 showing a third embodiment of the battery supporting means;

FIG. 20 is a perspective view of a fourth embodiment of the battery supporting means;

FIG. 21 is a section on line XXI—XXI of FIG. 20;

DETAILED DESCRIPTION OF THE INVENTION

Figure 1:
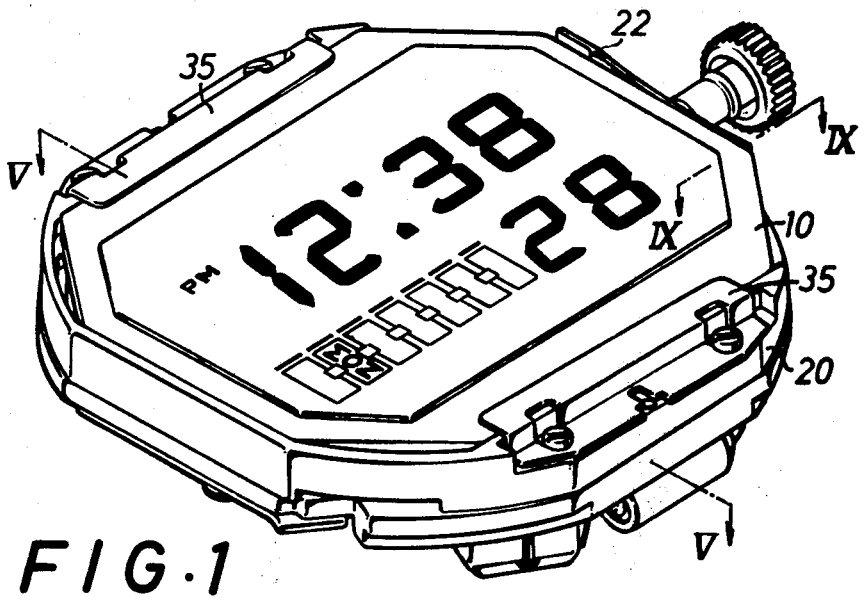
FIG. 1 is a perspective view of the liquid crystal display electronic watch according to the invention showing that side of a movement which is adjacent to a liquid crystal cell.

The invention will now be described mainly on the construction of the liquid crystal display electronic watch with reference to FIGS. 1, 2, 3, 4 and 5. Reference numeral 17 designates a disk-shaped metal substrate for supporting various constitutional elements of the watch. The substrate 17 is provided with a fixing or position determining hole or a tapped hole which engages with a pin or a tube secured to the position determining hole, an insulation pipe for upside and downside electric wirings, a pin extending through the insulation pipe and the like. The metal substrate 17 also constitutes a grounded terminal $v_{dd}$ for electric wirings. Reference numeral 18 designates an upside flexible print sheet for the upside electrical wirings, and is provided with an escape hole for a time keeping decoder drive circuit 9, and, an electrically conductive part having one terminal exposed at the escape hole in correspondence with an exterior lead wire of each of 58 pins of the time keeping decoder drive circuit 9. The electrical conductive part is connected to the exterior lead wire by means of solder bondage. The position of the upside print sheet 18 is determined by means of a pin projected from the metal substrate 17 and secured thereto. Reference numeral 19 designates a downside flexible print sheet for the downside electric wiring. Similar to the upside print sheet 18, the position of the downside print sheet 19 is determined by means of a pin projected from the metal substrate 17 and secured thereto. Both the upside and downside print sheets 18, 19 may be formed by the following process.

A plastic film previously coated with an adhesive agent is covered with a copper foil. The copper foil is subjected to etching to form a pattern whose desired portion is applied with solder or plated with gold. Then, the pattern is covered with an insulating coating except the soldered portion or contact portions. The laminated sheet thus obtained is provided with holes formed by punching and is subjected to bend-shaping so as to provide a dimensional wiring to complete each of the upside and downside print sheets 18 and 19. This process makes use of the film by which the successive steps can continuously be treated and hence provides a material increase in yield, requires the least parts necessary for effecting expensive plating and hence provides a material decrease in number of plating steps. The process is capable of effecting bend-shaping and hence is capable of using a single means of forming the three-dimensional wiring. As a result, both the upside and downside wirings can be performed with the aid of one print sheet, respectively.

Figure 3:
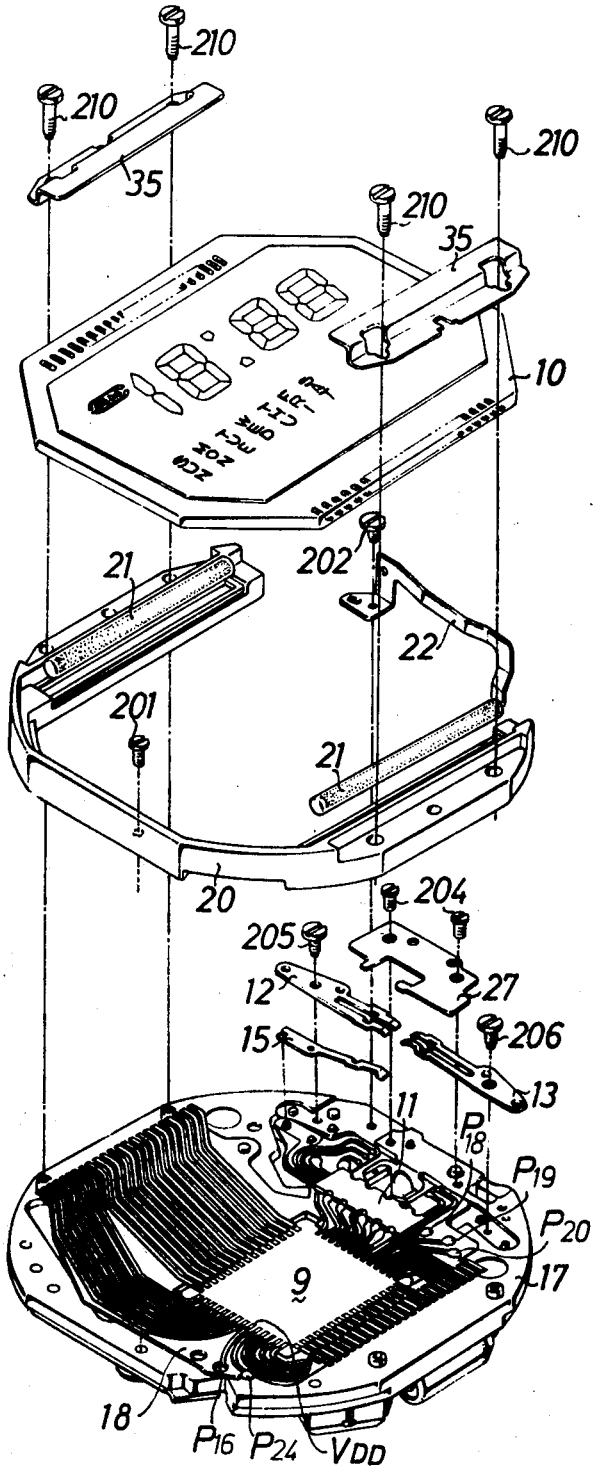
FIG. 3 is a disassembled view of FIG. 1.
Figure 6:
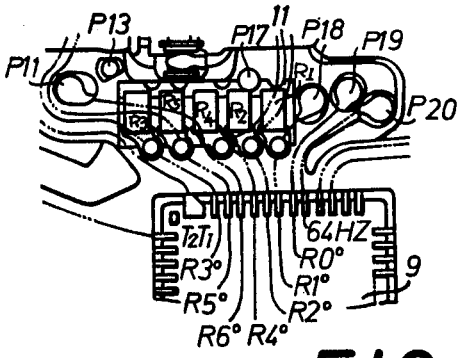
FIG. 6 is a detailed plan view of parts near a switch resistor 11 shown in FIG. 3.
Figure 7:
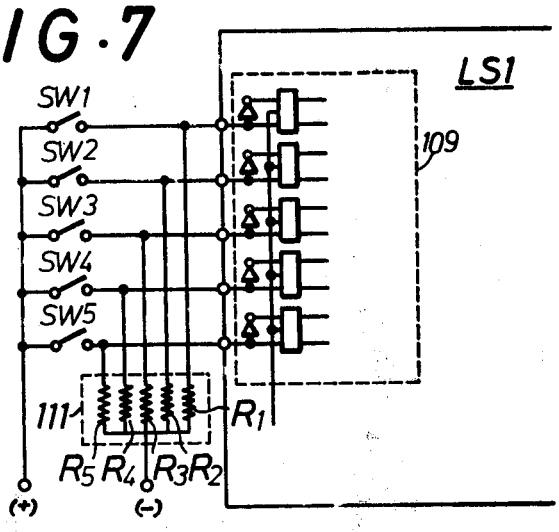
FIG. 7 is a circuit diagram of the switch resistor of the liquid crystal display electronic watch according to the invention.

In FIG. 3, reference numeral 11 designates a switch resistor composed of resistors $R_1$ to $R_5$. $P_{11}$, $P_{13}$, $P_{16}$, $P_{17}$, $P_{18}$, $P_{19}$, $P_{20}$ and $P_{24}$ (also refer to FIG. 6) show pins projected from the metal substrate 17 and extended through insulating pipes (not shown), respectively. These pins are soldered to electric conductive parts of the upside and downside print sheets 18 and 19, respectively, thereby connecting the upside print sheet 18 to the downside print sheet 19. The switch resistor 11 is formed on the wiring of the upside print sheet 18 located between input terminals $R_1°$ to $R_5°$ of the time keep decode drive circuit 9 and an exterior operating means (not shown) and is soldered to the terminals $R_1°$ to $R_5°$ and a pin $P_{13}$ (FIG. 3) connected to the terminal VssL. The terminal $V_{DD}$ of the time keep decode drive circuit 9 is connected by soldering to the pin $P_{16}$ projected from the metal substrate 17 and grounded through the metal substrate 17.

A novel construction and arrangement of a plurality of resistors which are required to hold a correction circuit in a stable state when the switch member is OFF will now be described in greater detail.

Figure 8:
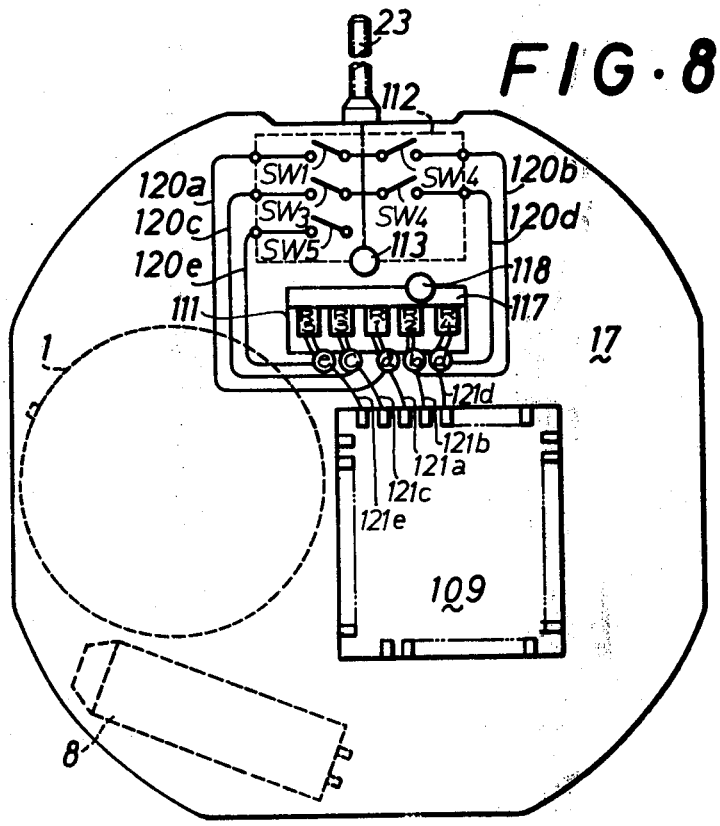
FIG. 8 is a circuit diagram of another embodiment of the switch resistor of the liquid crystal display electronic watch according to the invention.

In a second embodiment shown in FIG. 8, reference numeral 17 designates a watch substrate and 112 is a switch block including normally open switch members $SW_1$, $SW_2$, $SW_3$, $SW_4$, $SW_5$ suitably arranged on the metal substrate 17, the switch block 112 being diagrammatically shown for ease of illustration. Reference numeral 113 designates a (+) terminal connected to an electric source 1, and 23 an exteriorly operative member stem which, when pushed and pulled, is moved to three stable positions. At these three stable positions, the exteriorly operated member 23 can be rotated in left and right directions to make any one of the switch members ON. Numeral 111 designates a resistor substrate made of a thin ceramic material and the like and secured to that portion of the metal substrate 17 which is located near the switch block 112 by a suitable means such as cement bondage or the like. Numeral 117 is an electric conductive body provided for the resistor substrate 111 by such means as vapor deposition or printing. Numeral 118 is a (−) terminal connected to the electric conductive body 117 and grounded to (−) side. Letter $R_1$ to $R_5$ are thin or thick film resistors arranged on the resistor substrate 111 by such means as vapor deposition or printing, and are connected to the electric conductive body 117, respectively. Letters a to e are connection terminals of the film resistors $R_1$ to $R_5$, respectively. Numerals 9 is a time keep decode drive circuit inclusive of a correction circuit, a time keep circuit and a decoder circuit. Numerals 120a to 120e are electrical conductors for connecting the switch members $SW_1$ to $SW_5$ to the connection terminals a to e, respectively. Numeral 121a to 121e are electrical conductors for connecting the connection terminals a to e to the correction circuit of the time keep decode drive circuit 9, respectively, and numeral 8 is a crystal oscillator element.

In the present embodiment constructed as above described, if the switch members $SW_1$ to $SW_5$ are connected, for example, to the correction circuit of the time keep decode drive circuit 9 for correcting the display of week day, date, hour, minute and second and if the exterior operating member, in the present embodiment, the exteriocly operator member 23 is pushed and pulled to one of the stable positions and then is rotated to make the switch member $SW_1$ ON, the display of the week day may be corrected. The other display correction may be effected by operations similar to the above described operations.

As shown in FIG. 8, the resistor substrate 117 on which are arranged the thin or thin film resistors $R_1$ to $R_5$ by such means as vapor deposition or printing is connected to the electric conductive body 117 and is arranged near the switch members $SW_1$ to $SW_5$. This construction and arrangement are extremely compact and take up the least space and are capable not only of arranging any other members such as the time keep decode drive-circuit 9, electric source battery 1, crystal oscillator 8 and the like at their respective optimum positions, respectively, but also of making the electronic watch small and thin in thickness. In addition, the use of the thin or thick resistors $R_1$ to $R_5$, vapor deposited or printed on the signle resistor substrate 117, provides the important advantage that a level shifting resistor can be manufactured in an easy and less expensive manner.

Now, referring to FIGS. 2, 3, 4 and 5, reference numeral 20 designates a liquid crystal cell supporting frame whose position is determined by means of tubes projected from the metal substrate 17, which and is secured to the metal substrate 17 by means of screws 201 extending through these tubes and threadedly engaged with the metal substrate 17. Numeral 21 is an auxiliary rubber partly enclosed in a groove formed in the supporting frame 20 and for urging the electric conductive parts of the upside print sheet 18 against the exterior lead wires of a liquid crystal cell 10. The supporting frame 20 is made of flexible plastic and the supporting frame 20, after being resiliently deformed, is sandwiched between the upside print sheet 18 and the metal substrate 17. The flexible auxiliary rubber 21 is also sandwiched between the groove in the supporting frame 20 and the lower side of the print sheet 18.

Figure 9:
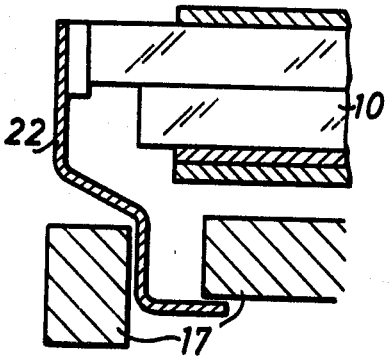
FIG. 9 is a section on line IX—IX of FIG. 1, shown in enlarged scale.

Reference numeral 22 (FIGS. 1, 3 and 9) designates a side pressing spring for urging the liquid crystal cell 10 against the supporting frame 20 in pitch direction of the exterior lead wires of the liquid crystal cell 10. The side pressing spring 22 is secured to the metal substrate 17 by means of a screw 202 which determines the position of the side pressing spring 22 with the aid of a pin projected from the metal substrate 17. The free end of the side pressing spring 22 is inserted into a deformed hole in the metal substrate 17 in order to prevent twist of the side pressing spring 22 as shown in FIG. 9.

Figure 10:
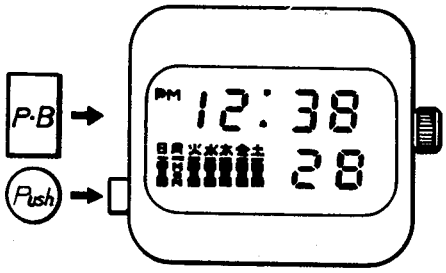
FIG. 10 is a plan view of the liquid crystal display electronic watch according to the invention with a case fixed thereto.
Figure 11:
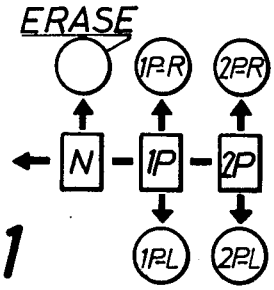
FIG. 11 is a diagrammatic view of the operating positions of the winding crown of the liquid crystal display electronic watch according to the invention.

Before describing the construction of an exterior operating means, its operation will now be described. In the same manner as the conventional watch, the adjusting crown which is like in conventional winding crown, is pushed and pulled and then rotated to open and close and change over the switch. As shown in FIGS. 10 and 11, the adjusting crown normally takes a position N. If the crown is rotated in right direction by 40°, the display is erased. If the crown is pushed, the display is changed over from date to second. If a user separates his finger from the crown, the display is returned to the second. If the crown is pulled by two steps, it reaches to a position 2P shown in FIG. 11 to change the display from date to second. At this position 2P, if the winding crown is rotated in left direction by 40°, it reaches to a position 2P-L to effect minute correction. If the crown is pulled by one step, it reaches to a position 1P shown in FIG. 11 where the date display is not changed. At this position 1P, if the winding crown is rotated in a left direction by 40°, it reaches to a position 1P-L to effect date correction. At the same position 1P, if the crown is rotated in a right direction by 40°, it reaches to a position 1P-R to effect week day correction.

As shown in FIG. 10, the watch is provided at that side which is opposed to the crown with a push button. If this push button is pushed, it is possible to reset the second indicator.

Figure 12:
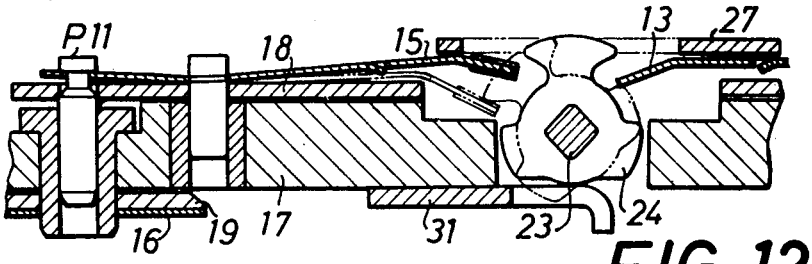
FIG. 12 is a section on line XII—XII of FIG. 4, parts being shown with turn inside out.
Figure 13:
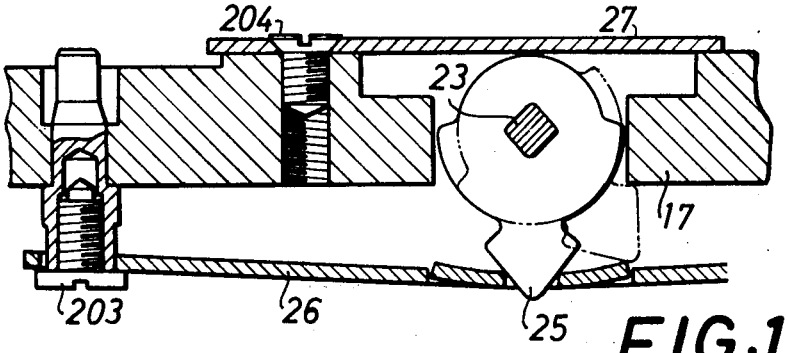
FIG. 13 is a section on line XIII—XIII of FIG. 4, the parts being shown with turn inside out.
Figure 25:
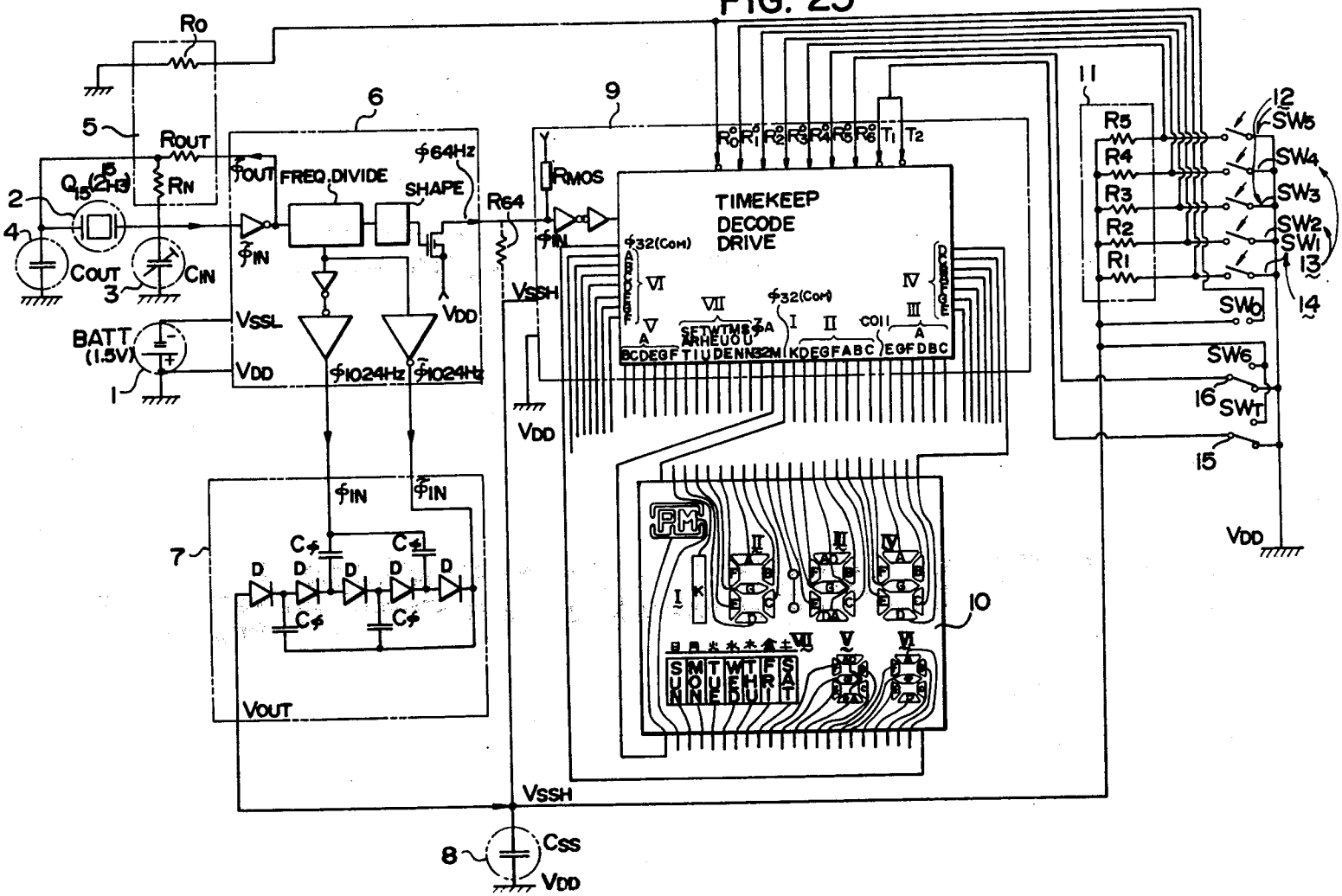
FIG. 25 is a circuit diagram of the liquid crystal display electronic watch according to the invention.

As shown in FIGS. 12 and 13, the stem 23 is directly connected to the crown, and is closely engaged with a hole in the metal substrate 17. With that portion of the stem 23 which is square in section are loosely engaged a switch wheel 24 and a pitch wheel 25 (FIG. 4) adapted to be rotated in phase with the switch wheel 24. The amount of rotation of the stem 23 and the switch wheel 24 in left and right directions is limited to 40° by means of the pitch wheel 25. When the pitch wheel 25 is engaged a pitch spring 26, which serves to determine the rotated position of the stem 23 and is used to obtain the switch wheel 24 and obtain the rotary pitch so that the user can recognize by his feeling the changed condition of the switch. The pitch spring 26 is secured to the metal substrate 17 means of screws 203 (FIG. 4) screwed into the pins projected from the metal substrate 17. Reference numeral 27 designates a plate for holding the pitch wheel 25 and is secured to the metal substrate 17 by means of pins projected from the metal substrate 17 and by screws 204 (FIG. 3) secured into these pins. Provision is made of a display erase spring 15 (FIG. 3) whose position is determined by pins secured through insulating pipes to the metal substrate 17. The front end of the display erase spring 15 is urged against the holding plate 27, while that portion of the display erasing spring 15 which is secured to the metal substrate 17 is urged against and connected to the electric conductive portions of input terminals $T_1$, $T_2$ of the time keep decode drive circuit 9 (FIG. 25). The display erasing spring 15 is provided at its front lower end with a VssH terminal spaced apart from the front end of the spring 15.

If the winding stem 23 is rotated in a right direction by 40°, the switch wheel 24 is rotated to push downwardly the display erasing spring 15. Then, the front end of the spring 15 is separated from the holding plate 27 and is urged against the terminals of VssH to make the terminals $T_1$, $T_2$ also VssH which is hereinafter denoted as "L". In this case, when the display erasing spring 15 makes direct contact with the switch wheel 24, the switch wheel 24 is grounded to $V_{DD}$, thereby shortcircuiting between the terminal $V_{DD}$ and the terminal VssH. In order to prevent such a shortcircuit, the display erasing spring 15 is provided at its front end which makes contact with the switch wheel 24 with an insulating sheet. If the switch wheel 24 is returned to its original position, the display erasing spring 15 is also returned to its original position by its own spring action and urged against the holding plate 27 to make contact with the terminals $T_1$, $T_2$ $V_{DD}$ which is hereinafter denoted as "H".

At the position N shown in FIG. 11, the holding plate 27 serves to prohibit the rotation of the switch wheel 24 so that it is impossible to rotate the winding crown in a left direction.

Provision is made for a week day correction spring 12, integral with a week day correction terminal, such that an hour correction terminal can be independently moved. The position of the week day correction spring 12 is determined by a screw 205 screwed into a pin projected from the metal substrate 17. The week day correction terminal and the hour correction terminal are provided at their lower sides with the terminals $R_5°$ and $R_3°$ with air gaps formed therebetween, respectively.

If the stem 23 is pulled by one step, the switch wheel 24 is moved to a position which corresponds to the week day correction terminal of the week hour correction spring 12. Then, if the stem 23 is rotated to the right, the switch wheel 24 is rotated to push downwardly the week day correction terminal. As a result, the week day correction terminal is urged against the terminal of $R_5°$ to make $R_5°$ "H". In this case, the hour correction terminal adjacent to the week day correction terminal constitutes an independent spring upon which is not subjected any influence of the hour correction terminal. If the switch wheel 24 is returned to its original position, the hour correction terminal is returned to its original position by its spring action. If the winding stem 23 is pulled by a further step, the switch wheel 24 is moved to a position which corresponds to the hour correction terminal and the above described operations are repeated in a similar manner. A day minute correction spring 13 is secured to the metal substrate 17 by means of a screw 206 as in the case of the above mentioned week hour correction spring 12 and operates in the same manner as the week hour correction spring 12. The terminal portion of each of these switch springs is bent by a working press and is bitten into and contacted with the wiring terminal of the print sheets 18 and 19. The switch spring is plated with gold, while the terminal portion only of the wiring terminal is also plated with gold.

The exteriorly operating member 23 and the switch wheel 24 may be thrusted by means of a setting lever 27, a clutch lever 28, a downside holding lever 29 and a setting lever spring 30 in the same manner as the downside operating means of the customary watch, the detailed description thereof being omitted. Between the setting lever 27 and the metal substrate 17 is arranged a detachable lever 34 which, when pushed from its upside or downside, is operated to raise the setting lever 27 to disengage the setting lever 27 from the winding stem 23 (refer to FIG. 16).

Figure 2:
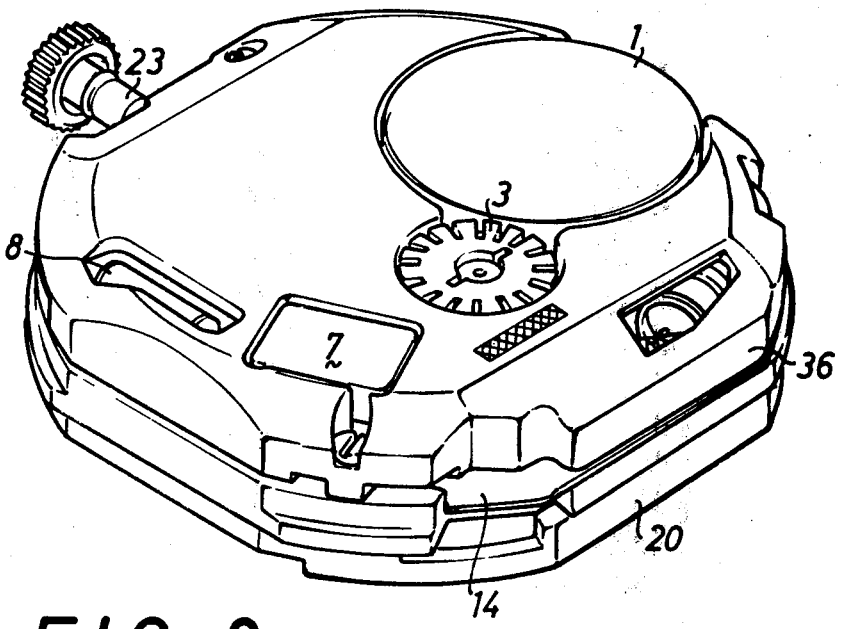
FIG. 2 is a perspective view of the liquid crystal display electronic watch according to the invention showing that side of the movement which is adjacent to a battery.
Figure 14:
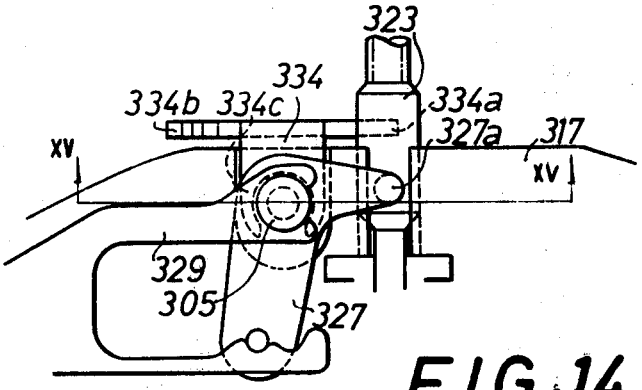
FIG. 14 is a fragmentary plan view of the liquid crystal display electronic watch according to the invention, showning details of the winding stem detachable mechanism.
Figure 15:
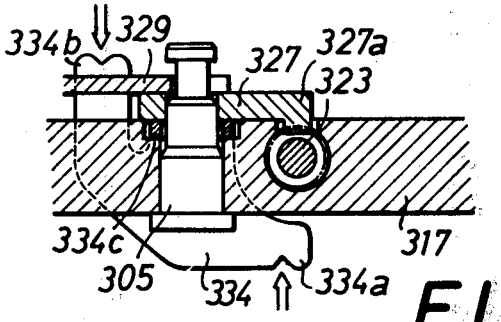
FIG. 15 is a section on line XV—XV of FIG. 14.

Now, the detachable lever 34 will briefly be described. FIG. 14 is a plan view of one embodiment of the winding stem detachable mechanism of the liquid crystal display electronic watch according to the invention. FIG. 15 is a section on line XV—XV of FIG. 14. In FIGS. 14 and 15, parts corresponding to those shown in FIGS. 2 and 3 are somewhat modified so that those parts are designated by like reference numerals added with 300. Reference numeral 317 designates a metal substrate, 323 a winding stem, and 327 *a* setting lever provided at one of its free ends with a projection 327*a* adapted to be engaged with a groove in the winding stem 323 and rotatable about a setting lever shaft 305. Reference numeral 329 desingates a downside holding plate having a front end urged against the setting lever 327, 334 a detachable lever mounted on a depressed portion 317*a* formed in the metal substrate 317 and located below the setting lever 327. The detachable lever 334 is provided at diametrically opposite sides of its center axis, which passes through the setting lever shaft 305 in parallel with the axis of the winding stem 323, with operating arms 334*a* and 334*b*, respectively.

Figure 16:
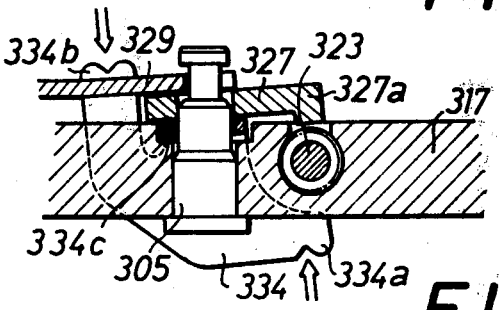
FIG. 16 is the same section as FIG. 15 showing the operated condition.

In FIG. 16 there is shown an operated condition of the detachable lever 334 shown in FIG. 15. If the above mentioned operating arms 334*a* and 334*b* are operated in directions shown by arrows from the side opposed to the setting lever 327 and from the same side as the setting lever 327, respectively, in both cases, the above mentioned setting lever 327 is raised about a supporting point formed by a portion 334*c* of the detachable lever 334 to disengage the projection 327*a* from the notch of the winding stem 323. As a result, it is possible to pull out the winding stem 323.

As stated hereinbefore, the invention is capable of operating one detachable lever 334 from either one of the up and down sides of the metal substrate 317 to raise the setting lever 327 in the same direction and provides the advantage that use may be made of two different types of cases, that the winding stem 323 may detachably be mounted without requiring any means other than the detachable lever 334, and that a winding stem detachably mounting mechanism can easily be designed.

Referring again to FIGS. 3,4,5,12 and 13, reference numeral 31 designates a switch wheel holding plate which can support the switch wheel 24 after the winding stem 23 has been removed and prohibit the movement of the switch wheel 24 at its correction rotating position in the thrust operating direction. If the switch wheel 24 is moved in the trust operating direction during its correction rotation, each of the switch springs is opened. In order to obviate such disadvantage, the switch wheel holding plate 31 is provided at its position which corresponds to the position of each thrust operating direction of the switch wheel 24 with a window into which is engaged a part of the switch wheel 24 at the correction rotating position, thereby preventing the switch wheel 24 from becoming moved in the thrust operating direction.

Figure 4:
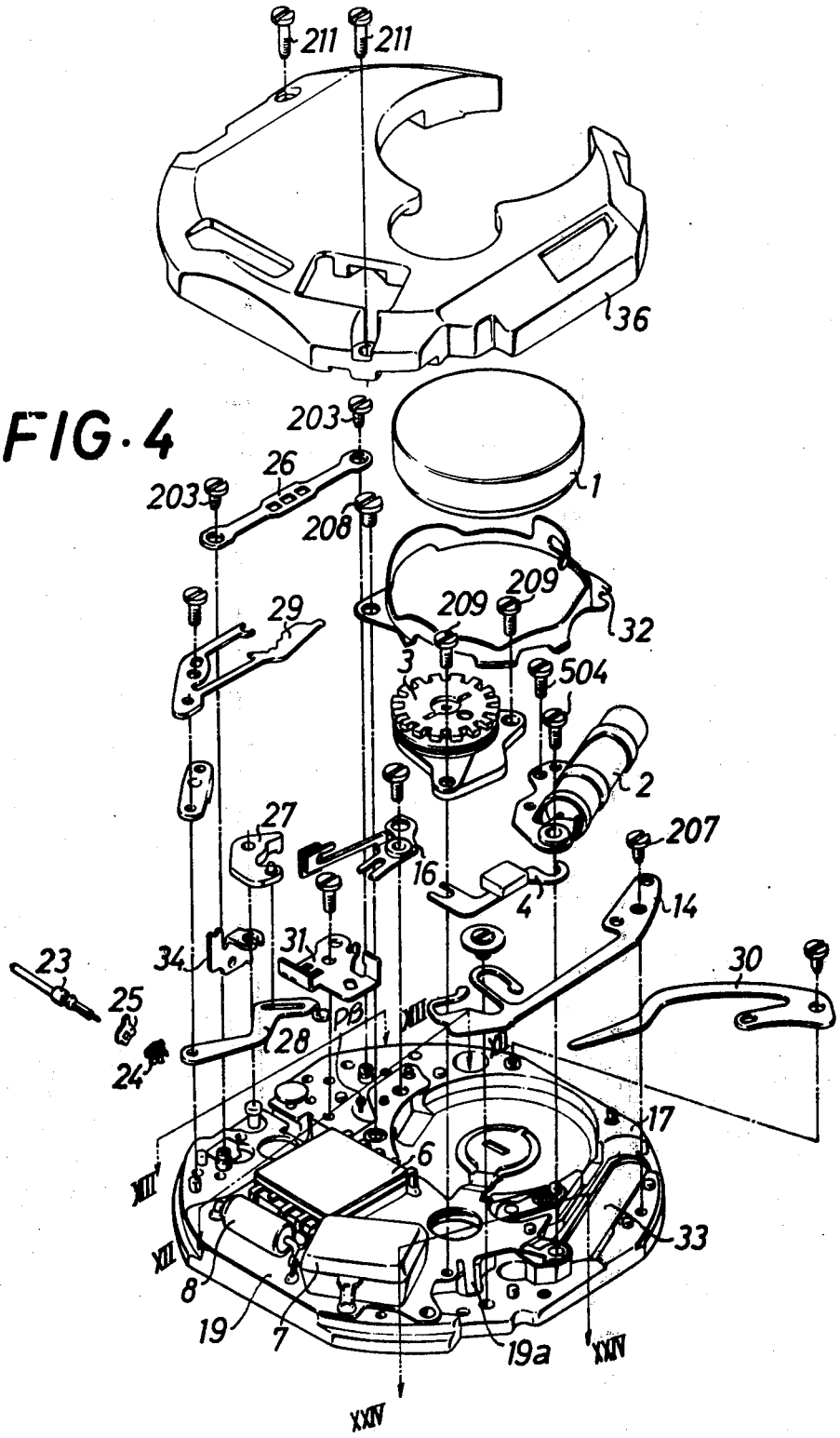
FIG. 4 is a disassembled view of FIG. 2.

As shown in FIGS. 4 and 12, provision is made for a display change over spring 16 located beneath the downside print sheet 19. The position of the display change over spring 16 is determined by means of an insulating pipe vertically secured to the metal substrate 17, and by a pin $P_{11}$ extending through the insulating pipe. The display change over spring 16 is secured through an insulating washer to the metal substrate 17 by means of a screw. The pin $P_{11}$ constitutes that terminal which is connected to the terminal $R_6°$ and is resiliently connected to the display erasing spring 15. The front end of the display erasing spring 15 is urged against the switch wheel holding plate 31 to make the terminal $R_6°$ "H" or high. If the winding stem 23 is pushed, the downside holding lever 29 causes the display erasing spring 15 to push downwardly and to be urged against the pin $P_{13}$ from VssH to make the terminal $R_6°$ "L" or Low. If the winding stem 23 is returned to its original position, the downside holding lever 29 is also returned to its original position and the display erasing spring 15 is returned to its original position by its own spring action. If the winding stem 23 is pulled by one step, the position of the front end of the downside holding lever 29 is not changed so that $R_6°$ remains "H". If the winding stem 23 is pulled by two steps, the same condition as in the case of pushing the winding stem 23 is produced. The display erasing spring 15 is provided at its contact portion with the downside holding lever 29 with an insulating sheet for preventing a shortcircuit between $V_{DD}$ and VssE.

As shown in FIG. 4, provision is made of a second zero returning lever 14 which is made integral with a pushphone type mounting spring member, a push pitch spring member and a contact spring member. The position of the second zero returning lever 14 is determined by pins projected from the metal substrate 17 and a screw 207 for securing the lever 14 to the metal substrate 17. The downside print sheet 19 is provided at its portion opposed to the side surface of the second zero returning lever 14 with a terminal 19a connected through the pin $P_{18}$ to the terminal $R_1°$, the terminal 19*a* being formed by bending the downside print sheet 19. If the push button is pushed, the second zero returning lever 14 becomes operated to urge its contact portion against the terminal 19*a* from $R_1°$, thereby making $R_1°$ "H". If the user releases the push button, the button is returned to its original position by the spring action of the second zero returning lever 14, thereby separating its contact portion from the terminal $R_1°$ and returning it to its original position.

Figure 5:
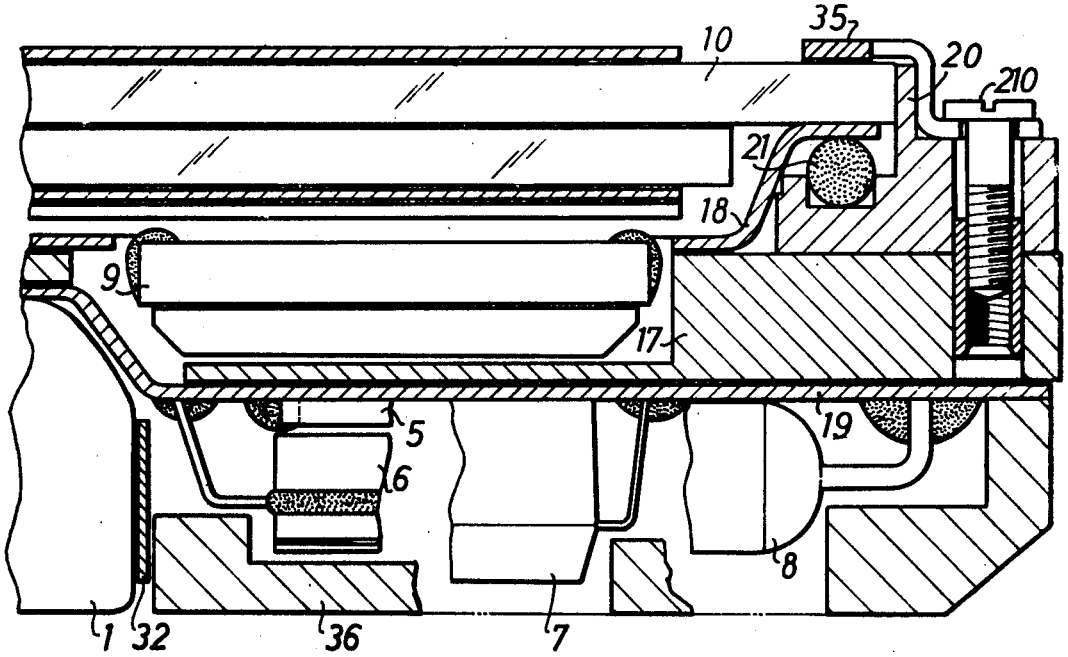
FIG. 5 is a section on line V—V of FIG. 1, shown in enlarged scale and parts being broken away for ease of illustration.

As shown in FIGS. 2, 4 and 5, the battery 1 is enclosed in a depressed portion of the metal substrate 17 and secured through an annular holding frame 32 to the metal substrate 17 by means of a screw 208. The (+) terminal of the battery 1 is connected through the annular holding frame 32 to $V_{DD}$ and the (−) terminal of the battery 1 is urged against the wiring portion of the downside print sheet 19.

FIG. 17 is a plan view of a second embodiment of the battery holding frame 32 shown in FIG. 4. FIG. 18 is a section on line XVIII—XVIII of FIG. 17. In FIGS. 17 and 18, like parts those shown in FIGS. 3, 4, 5, 12 and 13 are designated by the same reference numerals added with 400. Reference numeral 417 designates a metal substrate, 401 a battery, and 432 an annular holding frame. The annular holding frame 432 is provided at its diametrically opposite ends with flanges 432*a* and 432*b*. The flange 432*a* has its front fork-shaped end which engages with a reduced portion 404*a* of a pin 404. The flange 432*b* is secured through a tube 405 to the metal substrate 417 by means of the screw 208. The annular supporting frame 432 is composed of an annular portion 432*c* and a resilient portion 432*d*, these portions being press-shaped. The annular portion 432*c* has a diameter slightly larger than that of the outer periphery of the battery 401 and extends along substantially the total outer periphery of the battery 401. The annular portion 432*c* serves to determine the position of the battery 401 in its plane direction with respect to the metal substrate 417 and support the battery 401. The resilient portion 432*d* is formed by one portion of the annular portion 432*c* and urged against the side wall of the battery 401 to form one of the terminals, mostly (+) terminal of the battery 401. Dot-dash lines 432*d'* show the position of the resilient portion 432*d* prior to supporting the battery 401.

The present embodiment is capable of reliably supporting the battery 401 in its planar orientation even when the battery 401 is disposed on a metal substrate 417, whose thickness is comparatively thin. Experimental tests have yielded the result that a supporting frame 432 made of a metal having a thickness on the order of 150$\mu$ can sufficently endure an impulsive force of more than 1 g and provides a reliable contact without deforming the resilient portion 432*d*. In addition, the present embodiment has the advantage that the battery 401 can detachably be mounted on the metal substrate 417 in an easy manner, that a cover provided for the case can easily be opened and closed so as to replace the battery by a new one, and that the battery 401 can not simply be removed owing to the side pressure of the resilient portion 432*d*, even when the use is made of that movement only.

A third embodiment of the battery supporting frame will now be described with reference to FIG. 19. In the present embodiment, the metal substrate 417 is provided with an opening 417*a* in which is fitted a base 432*e* of the supporting frame 432 so as to support the battery 401 in its depthwise direction. The present embodiment renders it possible to make the thickness of the movement thin.

A fourth embodiment of the battery supporting frame will now be described with reference to FIGS. 20 and 21. In the second embodiment shown in FIGS. 17 and 18, the resilient portion 432*d* is urged against the side surface of the battery 401 so as to constitute the electrical connection terminal and also support the battery 401 in its depthwise direction. But, such resilient portion 432*d* is limited in its force for holding the battery 401.

As is shown in FIG. 20, the annular supporting frame 432 is provided at its diametrically opposite portions with resilient arms 432*f*, 432*f* whose upper ends are inwardly bent to form hook-shaped portions 432*g*. If the resilient arm 432*f* is biased outwardly as shown by dot-dash lines 432*f* in FIG. 21, the battery 401 can easily be removed therefrom by only pulling it up as shown by an arrow in FIG. 21. The present embodiment can reliably fix the battery 401 with the aid of the movement only.

As stated hereinbefore, the use of the supporting frame described above provides the important advantage that a battery can be held reliably on a comparatively thin metal substrate, that the supporting frame can be used as an electrical contact, and that the battery can detachably be mounted on the supporting frame in an easy manner.

As is shown in FIG. 5, a crystal resistor 5 is disposed on the wiring of the downside print sheet 19 and connected thereto by soldering. As oscillation frequency divider circuit 6, a booster circuit 7 and an electric source condenser 8 are disposed on the wiring of the downside print sheet 19 and exterior lead wires of these circuits and condenser are connected thereto by soldering.

In addition, the $V_{DD}$ terminals of the oscillation frequency divider circuit 6 and electric source condenser 8 are connected by soldering to a pin projecting from the metal substrate 17 and grounded thereto. Two exposed exterior terminals of the crystal oscillator 2 (FIGS. 22 to 24) are connected by soldering to the electric conductive part of a lug made of a flexible print sheet which is connected to the downside print sheet 19. The lug is bonded to the lower surface of a holder for supporting the packaged crystal oscillator. The lug is provided at its surface opposed to the crystal supporting frame with an electric conductive part, the other part being covered with an insulating coating. As a result, the crystal, the lug and the crystal supporting frame are assembled into one block. If a screw is tightened, so as to mount the crystal on the lug plate, the wiring of the downside print sheet 19 is simultaneously urged against the electric conductive part of the lug plate to effect an electrical connection there-between. In order to prevent the crystal from being subjected to shock, the crystal supporting frame is made elastic and a crystal receiving rubber mount 33 (FIGS. 4 and 24) is enclosed in a depressed portion in the metal substrate 17.

A method of electrical and mechanical connection of the crystal oscillator will now be described in greater detail with reference to a second embodiment shown in FIG. 22.

Figure 22:
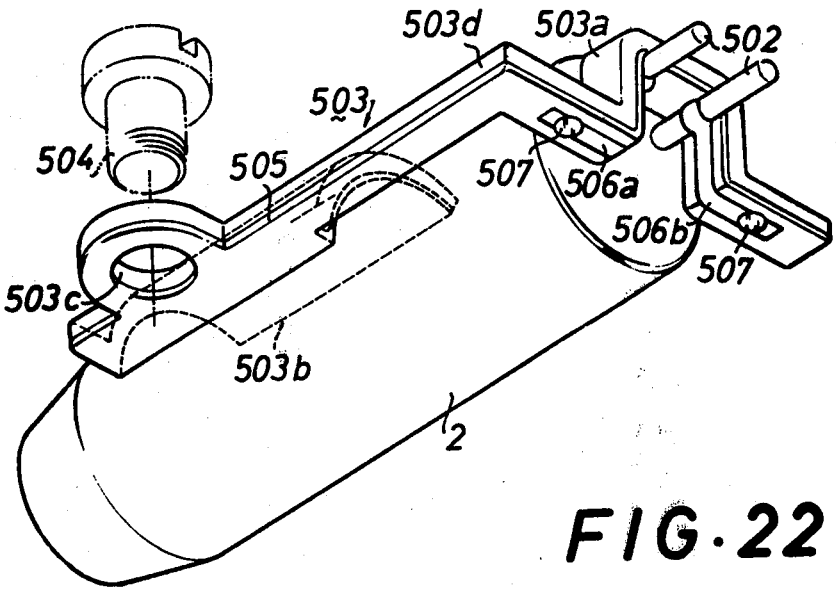
FIG. 22 is a perspective view of a second embodiment of the crystal oscillator supporting means of the liquid crystal display electronic watch according to the invention.

Referring to FIG. 22, reference numeral 2 designates an oscillator unit composed of a cylindrical case enclosing a crystal oscillator therein. Two terminals 502 of the crystal oscillator project out of the end surface of the case, and are insulated from each other. The oscillator unit 2 is supported on a substrate such as an electronic watch substrate by means of a supporting member 503. The supporting member 503 is made of a metal having a suitable elastic property and is composed of a substantially channel-shaped fitting part 503*a* and a embracing part 503*b* which makes contact with a peripheral surface of the oscillator unit 2. The fitting part 503*a* is provided with a fitting hole 503*c* through which is extended a fitting screw 504. The fitting screw 504 engages with the metal substrate to fix the fitting member 503 to a given place of the metal substrate. In this condition, the embracing part 503*b* causes the oscillator unit 2 to be urged against the surface of a depressed portion provided for the metal substrate, thereby fixing the oscillator unit 2 to a given place on the metal substrate. That portion of the fitting part 503*a* which is adjacent to the terminals 502 is so bent that the terminals 502 are surrounded by the bent portion.

The fitting part 503*a* is provided at its lower surface with an insulating part 505 made of a suitable flexible plastic, for example, polyimide polyester or the like. On the insulating part 505 are arranged a pair of electric conductive strips 506*a*, 506*b* bonded, printed or vapor deposited thereon. The electric conductive strips 506*a*, 506*b* are extended from those portions which make contact with the terminals 502, 502 in opposite directions from each other to the lower flange portion of fitting part 503*a* where the strips 506*a*, 506*b* are connected to contacts 507 made of gold and the like and having a comparatively small contact resistance.

The use of the fitting member 503 constructed, as described above, ensures not only a mechanical holding of the oscillator unit 2 at a given position of the metal substrate by only tightening the fitting screw 504, but also insures a contact between the contacts 507, 507 and contacts provided for the metal substrate and, hence, and electrical connection between the terminals 502, 502 and an exterior circuit, and provides the important advantage that the number of steps required for fitting the oscillator unit 2 on the metal substrate can be made small, and that the construction of the supporting device can be simplified.

Figure 23:
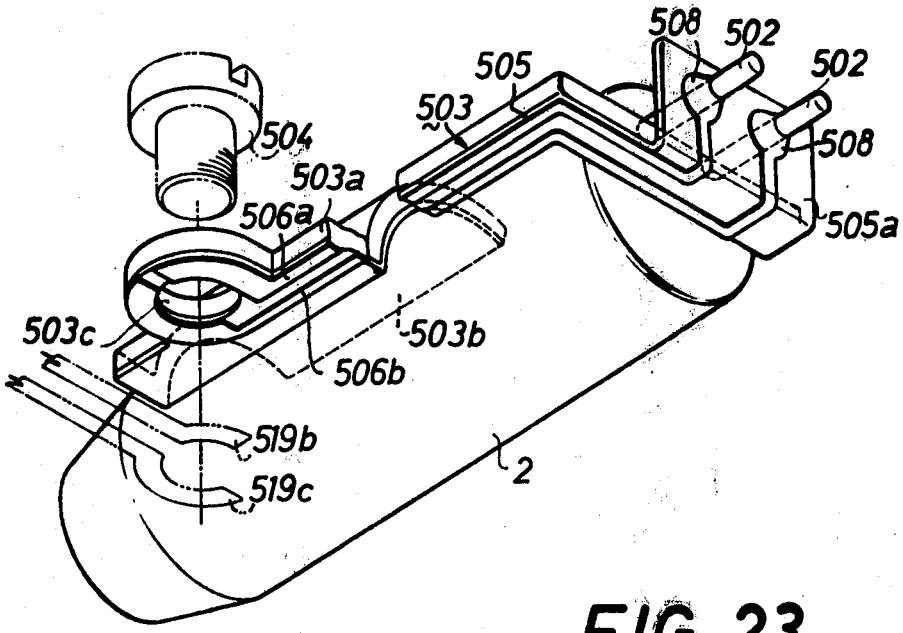
FIG. 23 is a perspective view of a third embodiment of the crystal oscillator supporting means.

In FIG. 23 there is shown another embodiment of the oscillator unit supporting device according to the invention. In FIG. 23, like numerals refer to like parts in FIG. 22. In the present embodiment, use may be made, as the insulating layer 505, of a flexible sheet made of polyimide, polyester and the like. A part of the sheet is provided at one end with a projection 505*a* extending over the upper surface of the fitting part 503*a*. The projection 505*a* is provided with holes for passing the terminals 502, 502. These terminals 502, 502 make contact with terminals 508, 508 of the electric conductive strips 506*a*, 506*b*, respectively. The electric conductive strips 506*a*, 506*b* are extended from the terminals 508, 508 to a position near the fitting hole 503*c*. In this case, the pressing force of the fitting screw 504 applied to the fitting part 503 causes the end surface of the electric conductive strips 506*a*, 506*b* to be effectively urged against electric conductive bodies 519*b*, 519*c* provided for the metal substrate 17. Thus, the present embodiment provides another advantage, in addition to those obtained by the previous embodiment shown in FIG. 22, that a further reliable electrical connection can be obtained.

Referring again to FIG. 4, a trimmer condenser 3 is arranged near the battery 1 such that the trimmer condenser 3 may be adjustable through the cover provided for the case in order to replace the battery 1 by a new one. The trimmer condenser 3 is electrically connected to the wiring of the downside print sheet 19 and to the metal substrate 17 by means of screws 209.

Figure 24:
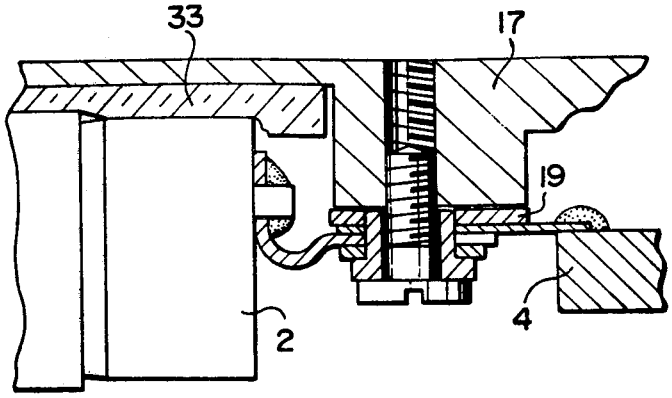
FIG. 24 is an enlarged section on line XXIV—XXIV of FIG. 4, being shown with upside down.

As shown in FIGS. 4 and 24, a fixed condenser 4 is detachably mounted through the downside print sheet 19 on the metal substrate 7 by means of the screw 504 passing throught the lug of the crystal oscillator supporting frame. If the screw 504 is tightened, the fixed condenser 4 is electrically connected to the wiring of the downside print sheet 19 and to the metal substrate 17.

As is shown in FIGS. 3, 5 and 9, the position of the liquid crystal cell 10, in its planar orientation, is determined by means of the supporting frame 20 and the side pressing spring 22. Provision is made for crystal cell holding frame plates 35 which engage with opposed sides of the liquid crystal cell 10. If screws 210 passing through the holding frame plates 35 are screwed into the metal substrate 17, the holding frame plates 35 cause the exterior lead wires of the liquid crystal cell 10 to be urged against the electric conductive parts of the upside print sheet 18. That surface of the holding frame plate 35 which is opposed to the liquid crystal cell 10 is coated with a buffer plate made of silicon and the like. The buffer plate is sandwiched between the holding frame plate 35 and the liquid crystal cell 10 for the purpose of relieving the shock subjected to the liquid crystal cell 10, and for the purpose of urging the holding frame plate 35 against the liquid crystal cell 10 in a stable manner.

Referring to FIGS. 4 and 5, reference numeral 36 designates a base cover made of plastic and covering the devices arranged on the rear surface of the movement. The base cover 36 is printed on its exposed surface with maker's number, type number, maker's country and other necessary marks and secured to the metal substrate 17 by means of screws 211.

All of the circuit elements according to the invention will now be described with reference to FIGS. 3, 4 and 25.

Reference numeral 1 designates a small silver battery which constitutes an electric source, the (+) electrode of being connected to the terminal $V_{DD}$ of the frequency divider circuit 6. The battery 1 has a size of 11.6 mm$\phi$ × 4.2 mm thickness and supplies a voltage of 1.5 V with a current capacity on the order of 100 mAh. Reference numeral 2 designates a liquid crystal oscillator unit having a frequency of 32768 Hz and enclosed in a vacuum capsule with two terminals exteriorly exposed, 3 a trimmer condenser adapted to continuously adjust the frequency of the liquid crystal oscillator unit 2, 4 a fixed condenser, 5 a crystal resistor composed of a bias resistor $R_N$, a feed back resistor Rout and a totally reset switch resistor $R_o$, all of these resistors being printed as a thick film on the same ceramic substrate, and 6 a C-MOS oscillation frequency divider circuit adapted to be operated at 1.5V. The oscillation frequency divider divider circuit 6 is aC-MOS-LSI comprising a C-MO inverter which, together with the crystal oscillator 2, trimmer condenser 3, fixed condenser 4 and crystal resistor 5, constitutes an oscillator; and a flip-flop for dividing the frequency 32768 Hz from the oscillator 2 into 64 Hz and the like, these constitutional elements being integrated and incorporated into the frequency divider C-MOS-LSI circuit 6.

As is shown in FIG. 25, the oscillation frequency divider circuit 6 is provided with seven pin-shaped terminals composed of a $V_{DD}$ terminal connected to the (+) terminal of the battery 1, a VssL terminal for supplying −1.5 V from the battery 1, a $\tilde{\phi}$ IN terminal which is an input terminal of the frequency divider circuit 6, a $\tilde{\phi}$ OUT terminal which is an output terminal of the frequency divider circuit 6, a $\tilde{\phi}$ 64 Hz terminal for supplying an output of 64 Hz, a $\tilde{\phi}$ 1024 Hz terminal for supplying a (−) output of 1024 Hz, and a $\phi$ 1024 Hz terminal for supplying a (+) output of 1024 Hz. All of the circuit elements are enclosed in a flat package (FIG. 5) and connected to exterior lead wires by wire bondage.

The booster circuit 7 is a hybrid integrated circuit composed of four condensers C$\phi$ and five diodes D and having eight exterior lead pins in total and boosting the 1.5V of the battery 1 to 6V. The $\tilde{\phi}$ 1024 Hz and $\phi$ 1024 Hz outputs from the oscillation frequency divider circuit 6 are supplied to $\phi$ IN and $\tilde{\phi}$ IN terminals of the booster circuit 7, respectively, and a 6V output from the booster circuit 7 is delivered from a Vout terminal. The condensers C$\phi$ and diodes D may be mounted on the upside and downside surfaces of a ceramic substrate by soldering, respectively, and the assembly may be embedded in a resin casing.

Figure 26:
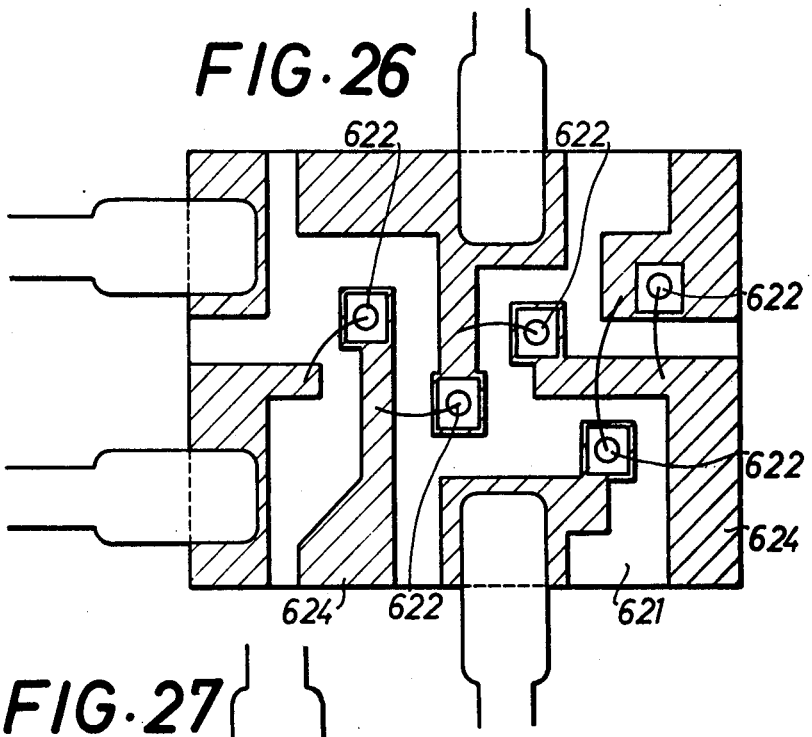
FIG. 26 is a top plan view of the booster circuit 7 shown in FIG. 25, showing the interior arrangement of the booster circuit constructed as the hybrid integral circuit.
Figure 27:
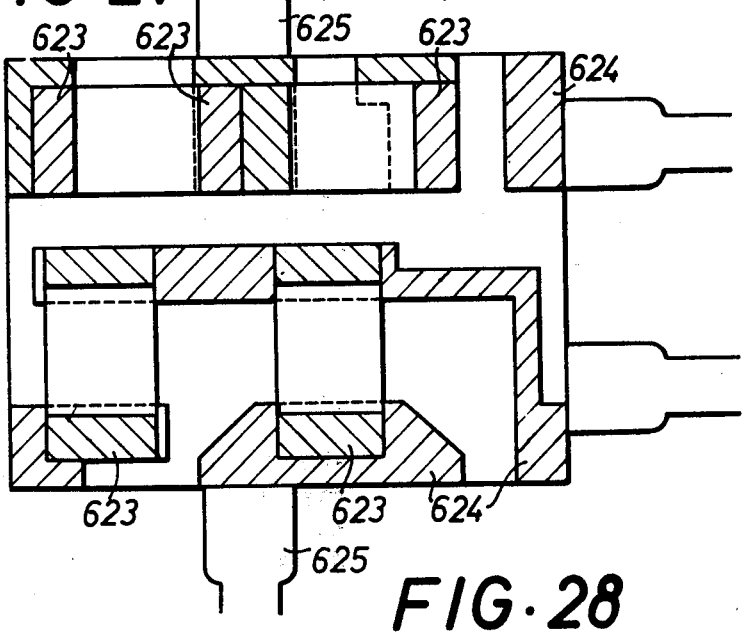
FIG. 27 is its downside plan view of the same interior arrangement of the booster circuit.
Figure 28:
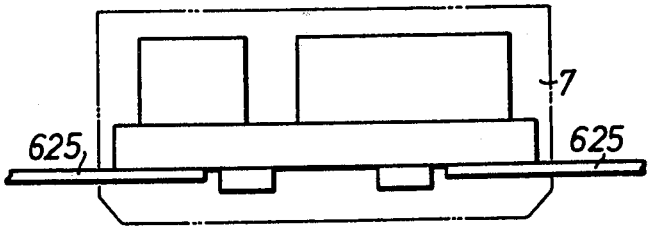
FIG. 28 is its sectional view.

In FIGS. 26, 27 and 28 there is shown an inside arrangement of the booster circuit 7 shown in FIG. 25 constructed as the hybrid integral circuit.

FIG. 26 shows an arrangement on the upside surface, FIG. 27 shows an arrangement on the downside surface and FIG. 28 shows a section of the arrangement shown in FIGS. 26 and 27. Reference numeral 621 designates a ceramic substrate, 622 a diode, 623 a condenser, 624 a lead electrode formed by printing and firing, and 625 input and output electrodes formed by printing and firing.

As seen from the above, the electronic watch according to the invention which makes use of the booster circuit 7 constructed as a hybrid integrated circuit has the advantage that a small booster circuit which can easily be manufactured and which takes up less space can be mounted on the watch.

As is seen in FIG. 4, essential electronic parts may be arranged on the metal substrate 17 in its plane direction or planar orientation. That is, the use of the booster circuit 7 constructed by the hybrid integrated circuit having the diode 622 and the condenser 623 arranged on the upside and downside surfaces of the ceramic substrate and molded in the resin casing as well as the use of the oscillation frequency divider circuit 6 constructed by the C-MOS circuit provide a liquid crystal display electronic watch which can be made thin, small and light in weight.

Now, referring again to FIGS. 4, 5 and 25, reference numeral 8 designates an electric source charging condenser and 9 a time keeping decorder drive circuit adapted to be operated by 6V and composed of a time keeping part for separating the $\phi$ 64 Hz input supplied from the oscillation frequency divider circuit 6 into second, minute and hour signals, a decoder part for converting the separated binary signals into a 32 Hz segment signal, a driver part, a control part for performing resetting and fast feed operations and the like, these parts being integrated to constitute a C-MOS-LSI.

The time keeping decoder drive circuit 9 includes pin shaped terminals which are fifty eight in number, and are composed of: a $V_{DD}$ terminal, a VssH terminal receiving (−) 6 V from the booster circuit 7, an input $\phi$ IN terminal receiving $\phi$ 64 Hz from the oscillation frequency divider circuit 6, segment output terminals for delivering 32 Hz, a segment common output $\phi$ 32 (com) terminal, control input $T_1$, $T_2$ terminals, and input $R_0°$ to $R_6°$ terminals. The LSI chip is enclosed in a leadless package, the chip being connected to the exterior lead wires by wire bondage.

Reference numeral 10 designates a twist type liquid crystal cell composed of upper and lower polarizing plates, upper and lower glass plates, a reflecting plate and a liquid crystal sandwiched between the upper and lower glass plates, hermetically sealed thereto by soldering and adapted to be operated by 6 V. The upper glass plate is provided at its surface opposed to the lower glass plate with a segment transparent elctrode, while the lower glass plate is provided at its surface opposed to the upper glass plate with a common transparent electrode. If the output phase between the segment 32 Hz signal from the time keep decode drive circuit 9 and the $\phi$ 32(com) signal from the segment common terminal causes a potential to be produced across the segment transparent electrode and the common electrode, the user can see the segment in black color.

On that portion of the upper surface of the reflection plate which is opposed to the transparent electrodes of the upper and lower glass plates week days are printed in Japanese and in English.

In addition, the upper glass plate is provided at that surface which is opposed to the lower glass plate with exterior lead wires which are 48 in total number, and extend from the transparent electrodes provided for the upper and lower glass plates. As a result, the signal delivered from the time keeping decoder drive circuit 9 causes the liquid crystal cell 10 to display "AM · PM" with the aid of AM/PM segments; "hours" with the aid of a combination of I-K segments and II - A to G segments; "minutes" with the aid of a combination of III - AD to G segments and IV -A to G segments; "date" or "seconds" with the aid of a combination of V - AD to G segments and VI - A to G segments; the "week day" with the aid of flushing of English letters at VII segments, and a colon with the aid of flickering light at COII segments.

Reference numeral II designates a switch resistor composed of switching resistors $R_1$ to $R_5$ printed as a thick film on a ceramic substrate and connected to corresponding control input terminals $R_1°$ to $R_5°$ of the time keep decode drive circuit 9, the common terminal of the switch resistor 11 being connected the VssH terminal.

Reference numeral 12 designates a week day correction spring (FIG. 3) for correcting a "time" switch $SW_3$ and "week day" switch $SW_5$. The spring 12 is connected to the grounded terminal $V_{DD}$. Numeral 13 is a date minute correction spring (FIG. 3) for correcting "minute" switch $SW_2$ and "date" switch $SW_4$. The spring 13 is connected to the grounded terminal $V_{DD}$. Numeral and 14 is a second resetting spring (FIG. 4) for resetting the second display to zero and connected to the grounded terminal $V_{DD}$. Reference numeral 15 designates a display erasing spring (FIG. 12) for erasing the display. The spring 15 is connected to the $T_1$ and $T_2$ terminals of the time keep decode drive circuit 9. Numeral 16 is a display change over spring (FIGS. 4 and 12) for effecting changing over between the "date" display and the "second" display and is connected to the $R_6°$ terminal of the time keep decode drive circuit 9.

The circuit input conditions of the time keeping decoder drive circuit 9 are shown in the following Table. Time correction and the like may be effected by the exterior operations as described with reference to FIG. 11.

| Operating condition | Input terminal | | | | | | |
|---|---|---|---|---|---|---|---|
| | $R_0°$ | $R_1°$ | $R_2°$ | $R_3°$ | $R_4°$ | $R_5°$ | $R_6°$ |
| N | H | L | L | L | L | L | H/L |
| P,B | H | H | L | L | L | L | H/L |
| 2P - R | H | L | L | H | L | L | L |
| 1P - L | H | L | L | L | H | L | H |
| 1P - R | H | L | L | L | L | H | H |
| SWo | L | L | L | L | L | L | H/L |

-continued

| Operating condition | Input terminal | | | | | | |
|---|---|---|---|---|---|---|---|
| | $R_0°$ | $R_1°$ | $R_2°$ | $R_3°$ | $R_4°$ | $R_5°$ | $R_6°$ |
| 2P - L | H | L | H | L | L | L | L |

where H = $V_{DD}$ terminal, L = VssH terminal.

Under the steady operating condition N (FIG. 11), the control input terminal $R_0°$ is connected through the resistor $R_0$ of the crystal resistor 5 to the grounded terminal $V_{DD}$ and the control input terminals $R_1°$ to $R_5°$ are connected through the resistors $R_1$ to $R_5$ to the terminals VssH. Under such steady state operating condition N, the control input terminal $R_6°$ is at "H" where the display change over spring 16 makes contact with the grounded terminal $V_{DD}$ and the "date" is displayed. The exterior operation makes it possible to operate the display change over spring 16 such that the spring 16 makes contact with the terminal $SW_6$ connected to the terminal VssH, and so that $R_6°$ becomes L, thereby effecting second display.

P.B is a second reset at which the push button causes the second return zero spring 14 to operate an make contact with the terminal connected to the terminal $R_1°$. At this instant, the terminal $R_1°$ becomes "H" to reset to 00 second. That is, fast a gain of 30 seconds is effected as soon as the push button is operated. In addition, the second display is preferentially effected irrespective of the condition of the terminal $R_6°$. In this case, the terminal $V_{DD}$ is shortcircuited through the resistor $R_1$ with the terminal VssH. But, this shortcircuit causes no trouble if use is made of the resistor $R_1$ whose resistance value is on the order of megaohm.

At the operating condition 2P-L, "minute" correction is effected at the operating condition 2P-R, "hour" correction is effected, at the operating condition 1P-L, "date" correction is effected and at the operating condition 1P-R, "week day" correction is effected. The exterior operations cause the day and minute correction spring 13 and the week day and hour correction spring 12 to operate and make contact with the terminals connected to the terminals $R_2°$ to $R_5°$, respectively. When the terminal $R_2°$ is at H, "minute" correction is effected at the interval of 1 second, when the terminal $R_3°$ is at "H" "hour" is corrected at the interval of 1 second when the terminal $R_4°$ is at "H", "date" is corrected at the interval of 1 second, and when the terminal $R_5°$ is at "H" "week day" is corrected at the interval of 1 second.

The minute correction takes a FIGURE up at 00 minute. The hour correction takes a FIGURE of "date" and "week day" up at 12 AM.

At the $R_6°$ input terminal, the exterior operation causes the display change over spring 16 to operate. Under the 2P operating condition, the second display is effected at "L". Under the 1P operating condition, the date display is effected at "H".

In this case, the terminal $V_{DD}$ is shortcircuited through $R_2$ to $R_5$ with VssH. But, this shortcircuit causes no trouble if use is made of the resistors $R_3$ to $R_5$ whose resistance value is on the order of a megaohm.

Figure 29:
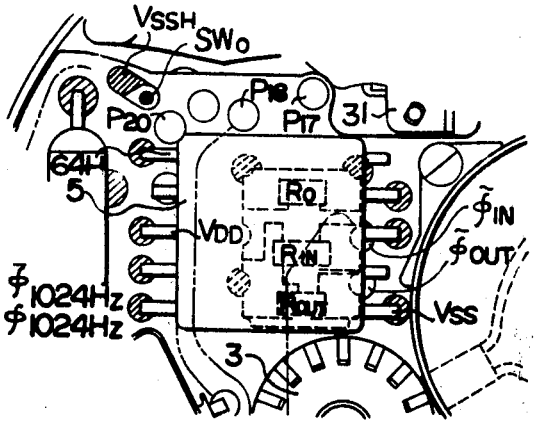
FIG. 29 is a fragmentary plan view of the liquid crystal display electronic watch according to the invention, showing details of the circuit elements near the oscillation frequency divider circuit 6 shown in FIG. 4.

As shown in FIG. 29, the SWo switch is adapted to reset all of the displays. The wiring is so made that the terminal connected to the terminal $R_0°$ is adjacent to the terminal connected to the terminal VssH. As a result, if these terminals make contact with each other by means of a pincette, or the like, the terminal $R_0°$ becomes "L" and the display is rest to 31st, Monday, 12 hour, 00 minute, 00 second, AM. By this correction step, it is possible to check the circuit function and the display function with reference to the date displayed. If the pincette is separated from the terminals, the terminal $R_0°$ again becomes "H" to start the operation. In this case, the terminal $V_{DD}$ is shortcircuited through the resistor $R_0$ with the terminal VssH. But, this shortcircuit causes no trouble if use is made of the resistor $R_0$ whose resistance value is on the order of megaohm. The control input terminals $T_1$ and $T_2$ connected to the display erasing spring 15 are at "H" and "H" under normal conditions when the display erasing spring 15 makes contact with the terminal connected to $V_{DD}$. If the exterior operation causes the display erasing spring 15 to make contact with the terminal $SW_T$ connected to the terminal VssH, the control input terminals $T_1$ and $T_2$ become "L" and "L", thereby erasing the display. In this case, the time keeping part of the time keeping decoder drive circuit 9 is operating so that the time is kept and that there is no risk of the time being out or order or inaccurate.

As described above, the watch function must be checked at the time of manufacturing the watch. The construction and arrangement for checking the watch function will now be described with reference to FIG. 29. Almost all of the surface of the upside of the metal substrate 17 is occupied by the liquid crystal cell 10 and it is difficult to carry out the wiring thereat, and as a result, it is preferable to arrange the function checking means beneath the downside of the metal substrate 17 or the downside surface of the watch for ease of operation.

After all of the circuit elements have been assembled, if the terminals thereof are arranged such that the quality of the circuit elements can easily be ascertained, the quality of the circuit elements can simply be checked with the aid of a measuring jig or pincette.

Figure 30:
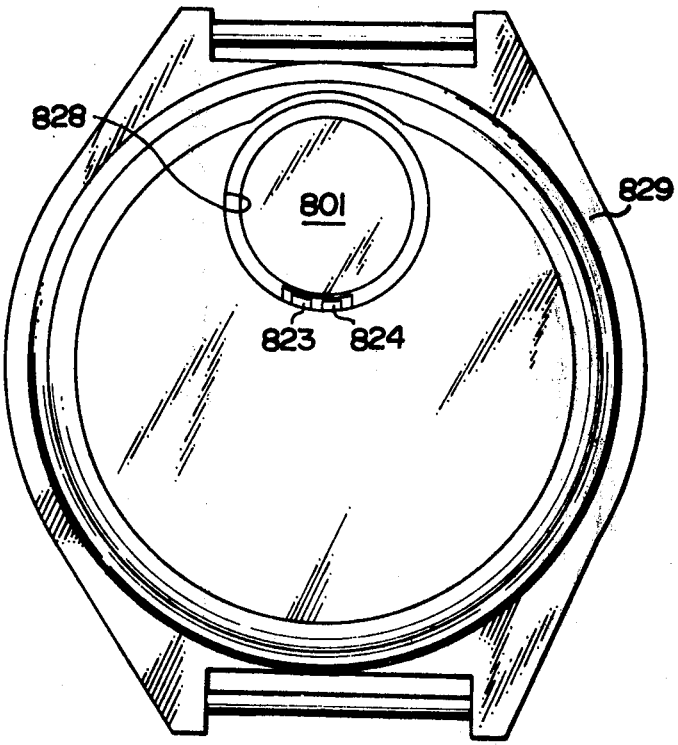
FIG. 30 is a rear view of the case showning a second embodiment of the SWo arrangement.

In FIG. 30 is shown another embodiment of the liquid crystal display electronic watch according to the invention. In the present embodiment, a case 829 is provided at its upper center of the downside with a hole 828 through which a battery 801 is detachably mounted on the metal substrate. In this case, after the watch has been completed, a cover (not shown) for closing the hole 828 may be opended so as to simply check the battery without carelessly applying a checking input to it when the user carries the watch.

When the battery 801 is inserted into the watch case 829, the display becomes irregular. This irregular display can be used to indicate the original point which plays the role of adjusting the display.

Alternatively, the circuit elements are so designed that only when the battery 801 is inserted into the watch case 829, the checking input can be supplied to the circuit, thereby making the function correcting operation easy.

The use of the above described arrangement provides a digital type electronic watch which can easily check the circuit and the display.

Figure 31:
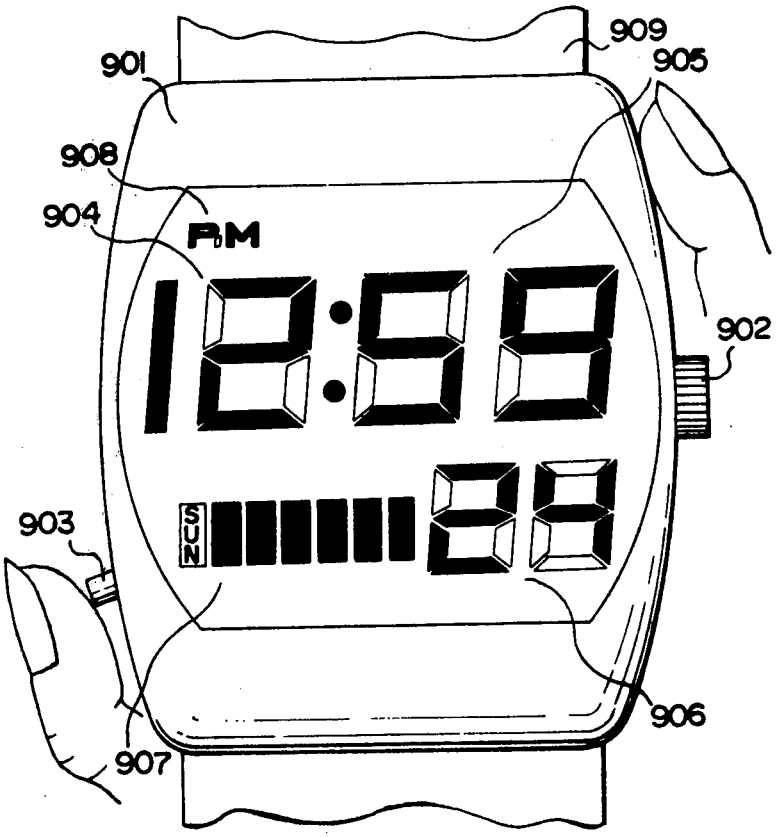
FIG. 31 is a plan view of the liquid crystal display electronic watch according to the invention, showing the relative arrangement of the winding crown and the push button.

In FIG. 31 is shown the most preferable arrangement of a push button and a crown. Reference numeral 901 designates a watch case; 902 a crown provided at that position of a conventional needle or hand type watch which corresponds to three o'clock position on the dial; 903 a push button provided at that position of the similar watch which corresponds to eight o'clock position on the dial; 904, 905 and 906 are hour, minute and date display parts made of liquid crystal and displaying these parts by ⊟-shaped seven segments; respectively, 907 a week day display part provided with week days printed in the same color as the condition under which the liquid crystal is applied with the voltage and displaying the week days by applying the voltage to the parts exclusive of a given part; 908 is an AM-PM display part; and 909 a watch band.

The switch mechanism (not shown) is operated such that if the winding crown 902 is pulled by one step and then rotated in left or right direction, the correction of the hour minute display parts 904, 905 is effected. If the winding crown 902 is pulled by two steps and then rotated in the left or right direction, correction of the day week day display parts 906, 907 is effected, and if the crown 902 is pushed from the ordinary condition, the second display is effected by the day display part 906. The push button 903 is so constructed that if the push button 903 is pushed, the second display is returned to zero.

As stated hereinbefore, the use of the crown 902 located at the position corresponding to three o'clock of the dial of the conventional needle or hand type watch and of the push button 903 located at the position corresponding to eight o'clock of the dial provides the important advantage that those mechanisms of the watch, which are operated by the crown and the push button, respectively, are, therefore not superimposed one upon the other and are not encumbered with the problems of comples construction, which makes design, working and the like troublesome, with this arrangement the push button can easily be operated and is balanced in appearance. In addition, the erroneous operation of the watch can be obviated by making the frequent correction operations independent from one another.

As stated hereinbefore, the use of a combination of the twist type liquid crystal and the C/MOS -LSI hybride booster circuit according to the invention ensures a material decrease in consumed current of a small type silver battery of the type having a capacity of 100 mAh to the order of $3\mu$A, and gives a significant increase to the life of the above battery to about 4 years. In practice, however, the life of the battery becomes shortened to about 2 to 3 years owing to the deterioration over time. In addition, the system as a whole is effectively arranged such that the movement is 28 mm$\phi \times$ 26 mm in dimension, shaped a circle with four corners cut into straight and 7 mm in thickness inclusive of the battery.

The invention provides a digital watch with features which have never been obtained by prior art techniques.

What is claimed is:

1. A liquid crystal display type watch comprising:

1. a metal substrate;
2. a front flexible print sheet mounted on the front side of said substrate;
3. a liquid crystal cell arranged on and connected to said front print sheet;
4. a timekeeping decoder driving circuit arranged on the front side of said substrate and connected to a wiring pattern on said front print sheet;
5. a rear flexible print sheet provided at the rear side of said substrate and at least a part of the print sheet connected to the wiring pattern on said front print sheet;
6. a crystal oscillator arranged at the rear side of said substrate and connected to said timekeeping decoder driving circuit through an oscillation frequency divider circuit;
7. a fixed condenser arranged at the rear side of said substrate and connected to the input of said crystal oscillator;
8. a trimmer condenser arranged at the rear side of said substrate and connected to the output of said crystal oscillator;
9. a booster circuit arranged at the rear side of said substrate and connected to the output of said oscillation frequency circuit for supplying high voltage to said timekeeping decoder drive circuit;
10. a battery cell arranged at said rear side of said substrate and connected to said oscillation frequency circuit for delivering a power to said timekeeping decoder drive circuit through said rear print sheet, said metal substrate and said front print sheet; and
11. switch means connected to said timekeeping decoder drive circuit and operated by a single exteriorly operating member.

2. The liquid crystal display type watch, as claimed in claim 1, wherein said switch means comprising a plurality of switch members adapted to be controlled by said exteriorly operating member, a level shifting resistor used for operating said switch members disposed adjacently to said switch members, and further mounted on the same resistor substrate.

3. The liquid crystal display type watch, as claimed in claim 1, further comprising a setting lever (327) unfastening lever mounted between said watch substrate (317) and a setting lever, secured through a setting shaft (305) to said watch substrate, having operating arms (334*a*) (334*b*) located at both sides of a centre line axis of the exteriorly operating member (323) parallel with said exteriorly operating member passing said setting lever shaft, whereby when said operating arm, located oppose to the said exteriorly operating member, is operated from the side of said watch substrate of the setting lever, and when said operating arm, located at the same sides, as said exteriorly operating member is operated from the opposite watch substrate side of the setting lever, said setting lever is raised in the same direction to permit said exteriorly operating member to be detached.

4. The liquid crystal display type watch, as claimed in claim 1, wherein said crystal oscillator (2) is enclosed in a case with at least two terminals (502) exteriorly exposed, said crystal oscillator being supported on sid watch substrate by means of a supporting member (503), said supporting member being provided through an insulating part (505) with electrically conductive parts (506*a*) (506*b*), the number of which is equal to the number of said terminals, and said terminals being connected through said electrically conductive parts to the exterior, when said crystal oscillator is secured to a given position of said watch substrate by means of said supporting member.

5. The liquid crystal display type watch, as claimed in claim 4, wherein one end of said electrically conductive part is extended along said supporting member into proximity with a position, where a fitting part (503*a*) for securing said supporting member to said watch substrate is located, said end of the electrically conductive part being closely contacted with the electrically conductive part provided for said watch substrate, thereby constituting a supporting device for the crystal oscillator.

6. The liquid crystal display type watch, as claimed in claim 1, further comprising a battery supporting member (432) composed of annular member (432*c*) provided at one part with a resilient portion (432*d*) formed by inwardly bending a portion of the battery supporting member (432) to hold said battery (401) detachably, provided at its lower end with a fitting part projecting perpendicular to said annular member.

7. The liquid crystal display type watch, as claimed in claim 1, wherein said oscillator circuit, oscillation frequency divider circuit and time keeping decoder drive circuit are complementary type MOS-IC circuits, and wherein said booster circuit is composed of condensers, diodes and a base plate, said booster circuit being arranged on the front side beneath the rear side of said base plate, respectively, and made into and integral body by resin, so as to form a hybrid structure.

8. The liquid crystal display type watch, as claimed in claim 1, and further comprising a checking terminal connected to every reset terminal of said watch circuits, and a level shifting electrode for determining the logic condition of said reset terminal, located adjacent to said checking terminal, said level shifting electrode being arranged, such that contact can be made with the electrodes by a metal instrument approaching from the rear side of the watch, when a back cover is removed.

9. The liquid crystal display type watch, as claimed in claim 1, wherein said exteriorly operated member (902) is capable of correcting at least hour and minute displays (904) (905) of time, and further comprises a push button (903) capable of correcting a given display, said exteriorly operated member being arranged at a center part of right side of the watch case (901) on the bearer's left hand in general, and said push button being arranged at the left side of the watch case (901), which is slightly below a center part of said left side.

10. A liquid crystal display type watch having a liquid crystal cell composed of upper and lower glass plates, a liquid crystal material sandwiched between said upper and lower glass plates, and electrode means for effecting exterior connections, disposed on one of said upper and lower glass plates;

a selection control circuit having exterior terminal means corresponding to said exterior connection electrode of the liquid crystal cell;

a watch substrate for determining the position of said liquid crystal cell and supporting said selection circuit, said watch substrate including means for aligning said exterior electrode means of the liquid crystal cell, and said exterior terminal means of the selection circuit in opposition with one another; and means attached to said substrate for holding the exterior electrode means and exterior terminal means in engagement with one another.

11. The watch of claim 10, wherein said holding means includes a resilient means behind said exterior terminal means urging said terminal means toward said liquid crystal cell, and a bracket engaging said liquid crystal cell retaining said cell and the exterior electrode means thereof against said exterior terminal means.

* * * * *